US011772849B2

(12) United States Patent
DeCarlo et al.

(10) Patent No.: US 11,772,849 B2
(45) Date of Patent: Oct. 3, 2023

(54) CLOSURE SYSTEM FOR POUCH OR CONTAINER

(71) Applicant: S. C. Johnson & Son, Inc., Racine, WI (US)

(72) Inventors: Stacey M. DeCarlo, Bay City, MI (US); Jeramy M Dubay, Hope, MI (US); Brian Dais, Freeland, MI (US); Therdsak Chalermwattananon, Bangbor (TH); Jose Porchia, Saginaw, MI (US)

(73) Assignee: S. C. JOHNSON & SON, INC., Racine, WI (US)

( * ) Notice: Subject to any disclaimer, the term of this patent is extended or adjusted under 35 U.S.C. 154(b) by 40 days.

(21) Appl. No.: 17/351,904

(22) Filed: Jun. 18, 2021

(65) Prior Publication Data

US 2022/0402658 A1 Dec. 22, 2022

(51) Int. Cl.
*B65D 33/25* (2006.01)
*B65D 33/00* (2006.01)

(52) U.S. Cl.
CPC ..... *B65D 33/25* (2013.01); *B65D 33/007* (2013.01)

(58) Field of Classification Search
CPC ... B65D 33/25; B65D 33/007; B65D 33/2508
USPC ..... 383/63
See application file for complete search history.

(56) References Cited

U.S. PATENT DOCUMENTS 4,356,954 A 11/1982 Mojonnier
4,620,320 A 10/1986 Sullivan
4,710,968 A * 12/1987 Borchardt ..... B65D 33/2541 24/339
4,736,496 A * 4/1988 Fisher ..... B65D 33/255 24/585.12
5,363,540 A * 11/1994 Dais ..... B65D 33/2541 24/585.12
5,647,100 A 7/1997 Porchia et al.
5,706,961 A * 1/1998 Morano ..... B65D 33/007 383/35

(Continued)

FOREIGN PATENT DOCUMENTS

CN 205574577 U 9/2016
DE 20006431 U1 8/2000

(Continued)

OTHER PUBLICATIONS

Invitation to Pay Additional Fees and, Where Applicable, Protest Fee for PCT/US2022/033455, mailed Oct. 11, 2022 (10 pages).

*Primary Examiner* — Jes F Pascua
(74) *Attorney, Agent, or Firm* — Quarles & Brady LLP

(57) ABSTRACT

A container or pouch made entirely from an elastomer includes a body having a front wall and a rear wall that is connected to the front wall along a peripheral edge, and a closure system that includes a front side having a front sealing profile that includes a male closure element, and a rear side having a rear sealing profile that includes a female closure element and defining a cavity, wherein a centerline extends through the cavity. The rear side includes an inner portion that includes the entire cavity and an outer portion. A thickness of the thickened region measured in a direction parallel to the centerline is less than 35% of a total thickness of the closure system in a closed configuration measured in a direction parallel to the centerline.

35 Claims, 13 Drawing Sheets

(56) References Cited

U.S. PATENT DOCUMENTS

| | | | | |
|---|---|---|---|---|
| 5,908,245 | A | 6/1999 | Bost et al. | |
| 6,059,456 | A | 5/2000 | May | |
| 6,152,600 | A * | 11/2000 | Tomic | B65D 33/2541 24/585.12 |
| 6,164,821 | A | 12/2000 | Randall | |
| 6,539,594 | B1 | 4/2003 | Kasai et al. | |
| 6,562,165 | B1 | 5/2003 | Bauman et al. | |
| 6,789,946 | B2 * | 9/2004 | Plourde | B65D 33/2541 24/399 |
| 6,805,485 | B2 | 10/2004 | Hogan et al. | |
| 6,860,952 | B2 | 3/2005 | Pawloski | |
| 7,267,856 | B2 | 9/2007 | Patel et al. | |
| 7,316,052 | B2 | 1/2008 | Pawloski et al. | |
| 7,461,434 | B2 | 12/2008 | Ackerman | |
| 7,574,782 | B2 | 8/2009 | Ackerman | |
| 7,575,127 | B2 | 8/2009 | Kishbaugh et al. | |
| 7,636,989 | B2 | 12/2009 | Plourde et al. | |
| 7,669,307 | B2 | 3/2010 | Patel et al. | |
| 7,758,242 | B2 | 7/2010 | May et al. | |
| 7,921,534 | B2 | 4/2011 | Patel et al. | |
| 8,142,077 | B2 | 3/2012 | Iannelli, II et al. | |
| 8,481,135 | B2 | 7/2013 | Nakajima et al. | |
| 8,558,149 | B2 | 10/2013 | Huber et al. | |
| 8,568,031 | B2 | 10/2013 | Price et al. | |
| 8,591,109 | B2 * | 11/2013 | Ackerman | A45C 11/20 383/105 |
| 8,714,821 | B2 | 5/2014 | Nanba et al. | |
| 8,727,620 | B2 | 5/2014 | Dais et al. | |
| 9,114,914 | B2 | 8/2015 | Dais et al. | |
| 9,126,735 | B2 | 9/2015 | Price et al. | |
| 9,273,938 | B2 | 3/2016 | McCarty | |
| 9,284,097 | B2 | 3/2016 | Heckman | |
| 9,371,153 | B1 | 6/2016 | Nouri et al. | |
| 9,475,616 | B2 | 10/2016 | Price et al. | |
| D770,916 | S | 11/2016 | Nouri et al. | |
| 9,573,730 | B2 | 2/2017 | Heckman | |
| 9,604,761 | B2 | 3/2017 | Dais et al. | |
| 10,011,396 | B2 | 7/2018 | Price et al. | |
| 10,065,770 | B2 | 9/2018 | Howell et al. | |
| 10,407,217 | B1 | 9/2019 | Nouri et al. | |
| 10,435,203 | B2 | 10/2019 | Dais et al. | |
| 10,450,106 | B2 | 10/2019 | Namba | |
| D876,217 | S | 2/2020 | Nouri et al. | |
| 10,618,697 | B2 | 4/2020 | Price et al. | |
| 10,625,906 | B1 | 4/2020 | Nouri et al. | |
| 10,633,166 | B2 | 4/2020 | Elkordy | |
| D894,691 | S | 9/2020 | Nouri et al. | |
| 10,793,325 | B2 | 10/2020 | Cheng | |
| D903,483 | S | 12/2020 | Nouri et al. | |
| D908,482 | S | 1/2021 | Nouri et al. | |
| 10,918,172 | B2 | 2/2021 | DeRue et al. | |
| D927,297 | S | 8/2021 | Carpinelli | |
| 2004/0234171 | A1 | 11/2004 | Dais et al. | |
| 2006/0104548 | A1 * | 5/2006 | Schreiter | B65D 33/2541 383/63 |
| 2007/0278221 | A1 | 12/2007 | Skaife | |
| 2009/0110335 | A1 | 4/2009 | LeBoeuf | |
| 2009/0129708 | A1 | 5/2009 | Kasai | |
| 2009/0300891 | A1 | 12/2009 | Nanba et al. | |
| 2010/0021090 | A1 | 1/2010 | Wilske | |
| 2011/0038564 | A1 | 2/2011 | Slansky | |
| 2012/0033899 | A1 | 2/2012 | Takamura | |
| 2014/0143988 | A1 | 5/2014 | Septien Rojas et al. | |
| 2014/0270579 | A1 | 9/2014 | Nouri | |
| 2016/0101905 | A1 | 4/2016 | Turvey et al. | |
| 2016/0130040 | A1 | 5/2016 | Yeh | |
| 2017/0265604 | A1 | 9/2017 | Martinson et al. | |
| 2018/0251267 | A1 | 9/2018 | Finell | |
| 2019/0104811 | A1 | 4/2019 | Martinson et al. | |
| 2019/0174876 | A1 | 6/2019 | Martinson et al. | |
| 2019/0216180 | A1 | 7/2019 | Martinson et al. | |
| 2019/0270546 | A1 | 9/2019 | Finell | |
| 2020/0148454 | A1 | 5/2020 | Black et al. | |
| 2020/0207520 | A1 | 7/2020 | Nouri et al. | |
| 2020/0284489 | A1 | 9/2020 | Finell | |
| 2021/0245920 | A1 * | 8/2021 | Maguire | B65D 33/2541 |

FOREIGN PATENT DOCUMENTS

| | | | |
|---|---|---|---|
| EP | 1187773 | B1 | 3/2004 |
| EP | 1309442 | B1 | 1/2005 |
| EP | 1407681 | B1 | 4/2007 |
| EP | 2221255 | B1 | 2/2013 |
| EP | 1870350 | B1 | 4/2013 |
| EP | 2735522 | B1 | 9/2015 |
| EP | 2485954 | B1 | 12/2017 |
| EP | 3241777 | B1 | 11/2019 |
| EP | 3226712 | B1 | 2/2020 |
| EP | 3626100 | A1 | 3/2020 |
| EP | 3369672 | B1 | 4/2020 |
| ES | 2562718 | B1 | 12/2016 |
| JP | 2005349012 | A | 12/2005 |
| JP | 5585674 | B2 | 9/2014 |
| TW | I663106 | B | 6/2019 |
| WO | 1993015969 | A1 | 8/1993 |
| WO | 2000078636 | A1 | 12/2000 |
| WO | 2014163712 | A1 | 10/2014 |
| WO | 2015128621 | A1 | 9/2015 |
| WO | 2016020560 | A1 | 2/2016 |
| WO | 2019204287 | A9 | 12/2019 |
| WO | 2020076670 | A1 | 4/2020 |
| WO | 2020102517 | A1 | 5/2020 |
| WO | 2020117313 | A1 | 6/2020 |
| WO | 2021159067 | A1 | 8/2021 |

* cited by examiner

CLOSURE SYSTEM FOR POUCH OR CONTAINER

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE DISCLOSURE

1. Field of the Disclosure

The present disclosure generally relates to pouches or containers comprising an improved closure system, and more particularly to closure systems having improved sealing members and/or cool touch tabs.

2. Description of the Background of the Disclosure

Historically, re-closeable pouches and containers (collectively "bags") that are used in food packaging comprise a folded web of elastomeric material, or a web formed of blown, cast, monolayer, or co-extruded films, and have two side walls that are folded at the bottom and sealed at the sides. The bags typically have a re-closable fastener or closure system at a top of the bag, such as, for example, an adhesive, a wire tie, or a plastic zipper. While thermoplastic bags have a variety of benefits, including reduced cost and ease of manufacture, efficient packaging and transport, and desirable sealing capabilities for end use, such bags are typically not re-usable, and given consumer trends related to re-usable packaging, new and improved food packaging bags are desired that maintain the benefits associated with prior art bags. It is therefore desirable to maintain or enhance the benefits of prior art bags through the use of materials that provide for repeated use, i.e., by using one or more sustainable materials.

Sealable bags that are also re-usable are known in the art. For example, elastomeric pouches having re-sealable closure mechanisms applied longitudinally across a mouth thereof that allow repeated opening and closing of the pouch are known in the art. One particular example of a known re-usable bag is described in U.S. Pat. No. 9,371,153, which describes elastomeric containers with integrated leak resistant seals. While elastomeric bags are becoming more desirable because of consumer demand for re-usable bags, these types of bags have different physical properties than existing thermoplastic bags, which requires different sealing mechanisms and considerations.

While the technology associated with the sealing mechanisms of existing thermoplastic bags has been developed over at least the last 70 years, the technology for sealing thermoplastic bags is not directly transferable to the requirements of elastomeric bags. This is especially so since some elastomeric bags may be used during cooking and may be exposed to extremes in temperature, pressure, and/or otherwise required to deal with various forces on the bag walls not typically contemplated with thermoplastic bags.

While improvements have been made to prior art sealing systems to provide for enhanced seals, such seals generally involve complicated structures, which can lead to increased complexity when manufacturing and using such sealing systems. Such sealing structures can include multiple pairs of opposing, interlocking closure profiles, which can be difficult to seal and/or can cause a user consternation in not knowing whether the multiple pairs of interlocking closure profiles have been properly sealed. These types of seals used with thermoplastic bags are not practical or directly transferrable to seals for elastomeric, re-usable bags. It is therefore desirable to provide a re-closable closure mechanism for an elastomeric pouch that includes a simpler sealing structure that is capable of providing an air-tight or water-tight seal, and that can be used in more rigorous applications.

Further, prior art bags that are formed of both elastomeric and thermoplastic materials typically do not include additional structure that allows a user to hold the bag, other than directly along and above the sealing structure. In particular, when a bag is filled with warm or hot contents, a user is not able to hold the bag along the sidewalls, and there are no places for the user to grasp the bag other than corners of the bag. While some prior art containers do include extensions that allow for a user to grasp a separate component when holding the bag, such designs are not ergonomic, and do not provide for an easily identifiable cue to a user that the extension is intended to be grasped when holding a bag with warm or hot contents.

Therefore, a need exists for re-usable pouches or containers that alleviate one or more of the problems associated with, or particular to, existing containers and pouches.

SUMMARY OF THE DISCLOSURE

The present disclosure provides for an enhanced closure system that includes a sealing structure that allows for quick and easy sealing and unsealing, and/or cool touch tabs that allow a user to grasp the bag in a desirable location along the closure system. In some embodiments, a container or pouch made entirely from an elastomer includes a body comprising a front wall, and a rear wall that is connected to the front wall along a peripheral edge, and a closure system comprising a front side having a front sealing profile that includes a male closure element, and a rear side having a rear sealing profile that includes a female closure element and defining a cavity. A thickness of the thickened region measured in a direction parallel to the centerline is less than 35% of a total thickness of the closure system in a closed configuration measured in a direction parallel to the centerline.

In some embodiments, the thickness of the thickened region is less than 30% of the total thickness of the closure system. In some embodiments, the thickness of the thickened region is less than 25% of the total thickness of the closure system. In some embodiments, the thickness of the thickened region is less than 20% of the total thickness of the closure system. In some embodiments, the closure system further includes a left tab and a right tab that extend in an outward direction.

In some embodiments the male closure element comprises a stem and a head portion that extends from the stem. The head portion defines a height that is larger than a height of the stem, the female closure element includes arms that define an opening into the cavity, the opening defines a height, and the height of the stem is at least 100% of the height of the opening. In some embodiments, the height of the stem is at least 125% of the height of the opening. In some embodiments, the height of the stem is at least 150% of the height of the opening.

According to some embodiments, a container or pouch made entirely from an elastomer includes a body comprising a front wall and a rear wall that is connected to the front wall along a peripheral edge, and a closure system comprising a front side having a front sealing profile that includes a male closure element, and a rear side having a rear sealing profile that includes a female closure element and defining a cavity. A centerline extends through the cavity, the male closure element comprises a stem and a head portion that extends from the stem, and a height of the stem measured in a direction that is perpendicular to the centerline is between about 10% and about 50% of a height of the female closure element measured in a direction that is perpendicular to the centerline.

In some embodiments, a centerline extends through the cavity, the rear side includes an inner portion that includes the entire cavity and an outer portion, and a thickness of the outer portion measured in a direction parallel to the centerline is at least 20% of the total thickness of the female closure element measured in a direction parallel to the centerline. In some embodiments, the thickness of the outer portion is at least 30% of the total thickness of the female closure element. In some embodiments, the height of the stem is between about 20% and 40% of the height of the female closure. In some embodiments, the height of the stem is less than about 35% of the height of the female closure. In some embodiments, the closure system further includes a left tab and a right tab that extend in an outward direction. In some embodiments, the left tab and the right tab include a plurality of protrusions or grooves.

According to some embodiments, a container or a pouch made entirely from an elastomer includes a body comprising a front wall and a rear wall that is connected to the front wall along a peripheral edge, and a closure system comprising a front side having a front sealing profile that includes a male closure element, wherein the male closure element comprises a stem and a head portion that extends from the stem, and a rear side comprising a rear sealing profile comprising a female closure element and defining a cavity, wherein a centerline extends through the cavity, and wherein the rear side comprises an inner portion that includes the entire cavity and an outer portion. The outer portion defines a thickness of between 3.0 millimeters (mm) and 6 mm, and the male closure element defines a thickness of less than 3.5 mm.

In some embodiments, the male closure element defines a thickness of less than 3.0 mm. In some embodiments, a thickness of the outer portion measured in a direction parallel to the centerline is at least 20% of a total thickness of the female closure element measured in a direction parallel to the centerline. In some embodiments the left tab and the right tab each include a plurality of grooves or protrusions. In some embodiments, the left tab and the right tab each include a plurality of apertures.

In some embodiments, a container or pouch made entirely from an elastomer includes a body comprising a front wall, and a rear wall that is connected to the front wall along a peripheral edge, and a closure system comprising a front side having a front sealing profile that includes a male closure element, and a rear side having a rear sealing profile that includes a female closure element and defining a cavity. A centerline extends through the cavity, and the rear side comprises an inner portion that includes the entire cavity and an outer portion. A thickness of the outer portion measured in a direction parallel to the centerline is at least 20% of a total thickness of the female closure element measured in a direction parallel to the centerline.

In some embodiments, the thickness of the outer portion is at least 30% of the total thickness of the female closure element. In some embodiments, the thickness of the outer portion is at least 40% of the total thickness of the female closure element. In some embodiments, the thickness of the outer portion is at least 50% of the total thickness of the female closure element. In some embodiments, the closure system further includes a left tab and a right tab that extend in an outward direction.

In some embodiments the male closure element comprises a stem and a head portion that extends from the stem. The head portion defines a height that is larger than a height of the stem, the female closure element includes arms that define an opening into the cavity, and the opening defines a height, and the height of the stem is at least 100% of the height of the opening. In some embodiments, the height of the stem is at least 125% of the height of the opening. In some embodiments, the height of the stem is at least 150% of the height of the opening.

According to some embodiments, a container or pouch made entirely from an elastomer includes a body comprising a front wall and a rear wall that is connected to the front wall along a peripheral edge, and a closure system comprising a front side having a front sealing profile that includes a male closure element, and a rear side having a rear sealing profile that includes a female closure element and defining a cavity. The male closure element comprises a stem and a head portion that extends from the stem, the head portion defines a height that is larger than a height of the stem, the female closure element includes arms that define an opening into the cavity, and the opening defines a height, and the height of the stem is at least 100% of the height of the opening.

In some embodiments, a centerline extends through the cavity, the rear side includes an inner portion that includes the entire cavity and an outer portion, and a thickness of the outer portion measured in a direction parallel to the centerline is at least 20% of the total thickness of the female closure element measured in a direction parallel to the centerline. In some embodiments, the thickness of the outer portion is at least 30% of the total thickness of the female closure element. In some embodiments, the height of the stem is at least 125% of the height of the opening. In some embodiments, the height of the stem is at least 150% of the height of the opening. In some embodiments, the closure system further includes a left tab and a right tab that extend in an outward direction. In some embodiments, the left tab and the right tab include at least one of a protrusion or a groove.

BRIEF DESCRIPTION OF THE DRAWINGS

Other aspects and advantages of the present disclosure will become apparent upon consideration of the following detailed description, wherein similar structures have similar reference numerals.

DETAILED DESCRIPTION

Figure 2:
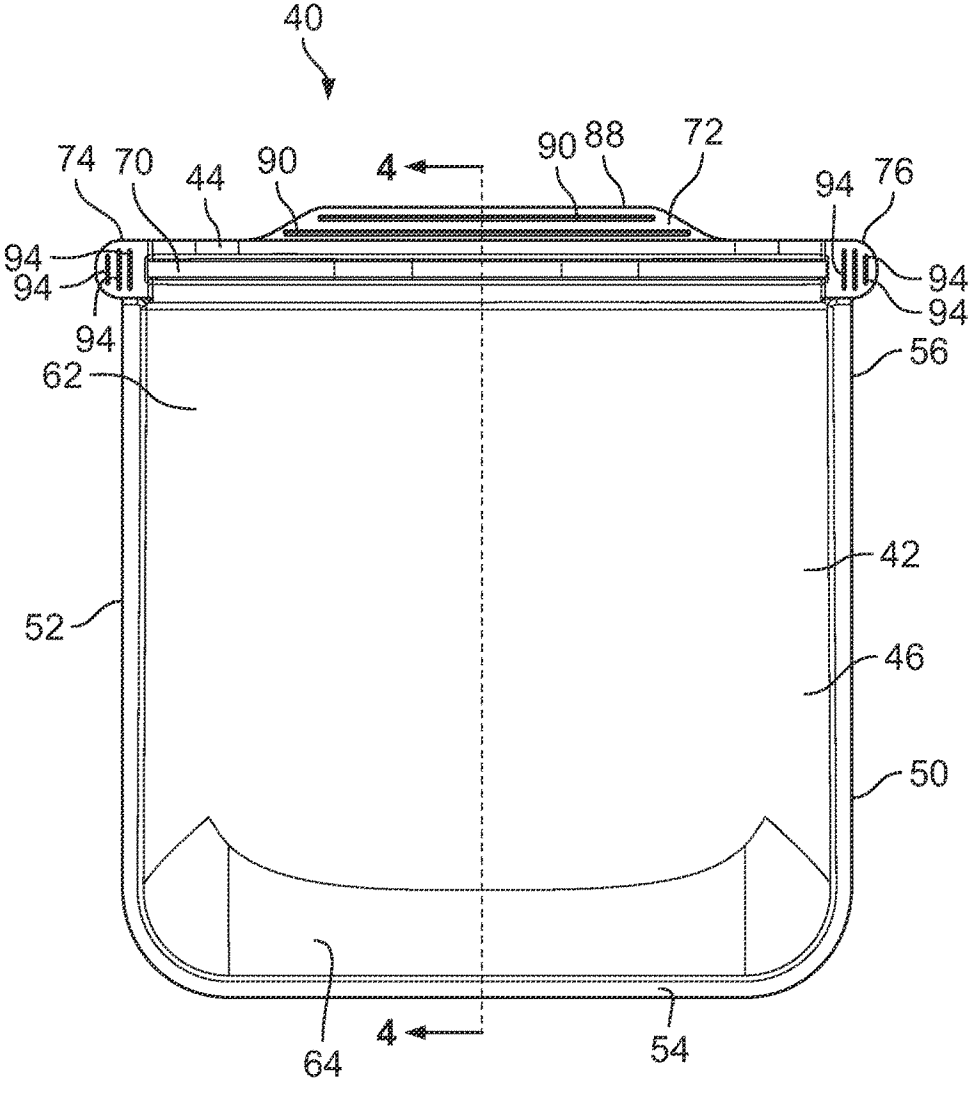
FIG. 2 is a front elevational view of the pouch of FIG. 1.

The present disclosure is directed to pouches and containers comprising an improved closure system, and more particularly to closure systems having improved sealing members and/or cool touch tabs. While the systems disclosed herein may be embodied in many different forms, several specific embodiments are discussed herein with the understanding that the embodiments described in the present disclosure are to be considered only exemplifications of the principles described herein, and the disclosure is not intended to be limited to the embodiments illustrated. Throughout the disclosure, the terms "about" and "approximate" mean plus or minus 5% of the number or value that each term precedes. As used herein, the phrase "elastomer" refers to a material which at room temperature can be stretched repeatedly and, upon immediate release of the stress, will return with force to its approximate original length. Further, the phrase "leak resistant seal" refers to a seal that resists leakage of liquids and solids from the container during storage and transport without the aid of an external structure to maintain the seal. Finally, the term "closure element" is defined herein to mean one part of a closure. For example, on a zipper closure, a closure element is one profile or the other of the zipper, e.g., a rib profile or a groove profile.

The present disclosure is related to storage pouches and containers that include one or both of an improved zipper design and cool touch tabs. The pouches and containers may take varying forms, and representative examples are provided in FIGS. 1-14. While the embodiments disclosed herein are formed entirely by an elastomer, such as silicone, it is contemplated that multiple components may be coupled or formed together to achieve the embodiments disclosed herein. While varying manufacturing methods may be used, the pouches and containers disclosed herein may be manufactured using a Liquid Injection Mold Process (LIM process) through which the entire pouch or container is molded in one piece and is made of silicone. Alternative methods of manufacture may be implemented, such as compression molding, transfer molding, extrusion, blow molding, sheet extrusion, and thermal forming.

Referring now to FIGS. 1-4, a re-closable pouch 40 is shown that includes a body 42 and a closure system 44, as disclosed herein. The pouch 40 may be entirely made of one or more elastomeric materials, and may comprise one or more of an unsaturated rubber, a saturated rubber, or a thermoplastic elastomer (TPE), among other elastomeric materials. When the pouch 40 is molded as a unitary component, leak paths along edges of the pouch are minimized or eliminated since no additional sealing is required along the various edges of the pouch 40, in contrast to many prior art plastic zippered bags. By forming the pouch 40 as a unitary component, the structural integrity of the pouch 40 is enhanced. Since the entire pouch 40 is constructed of an elastomer, the pouch 40 is considered to be a long-life container.

Figure 1:
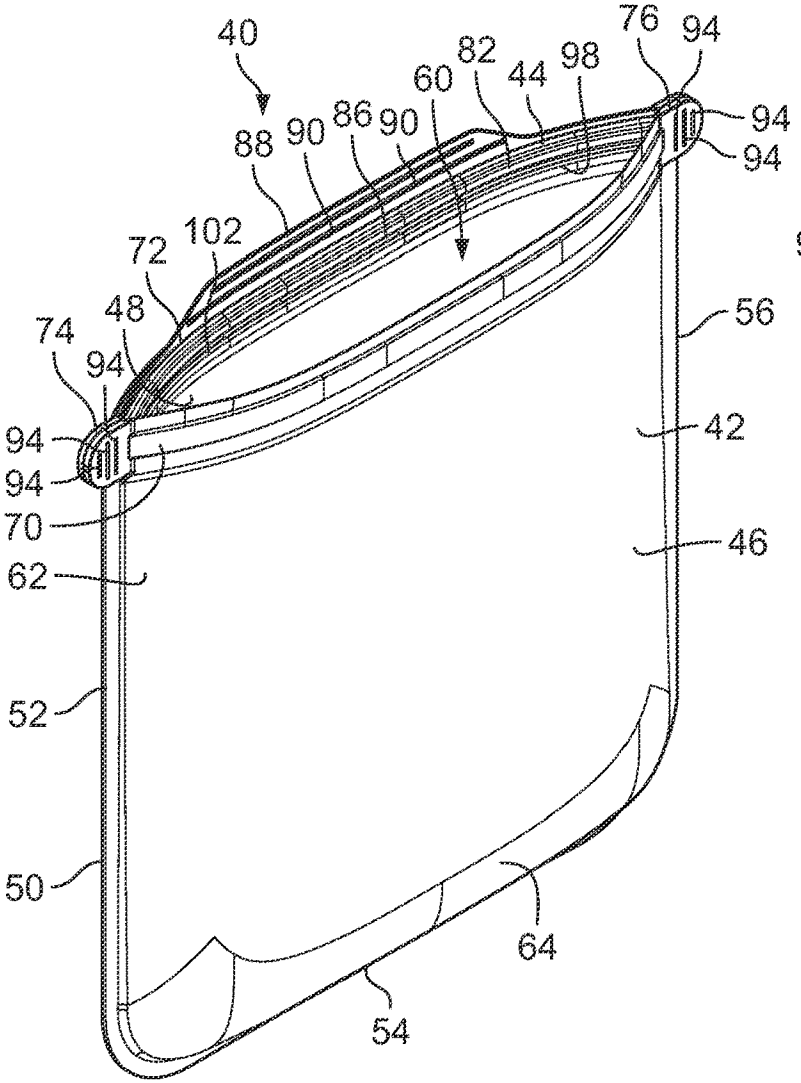
FIG. 1 is an isometric view of a first embodiment of a pouch having a closure system as disclosed herein, and shown in an open configuration.
Figure 3:
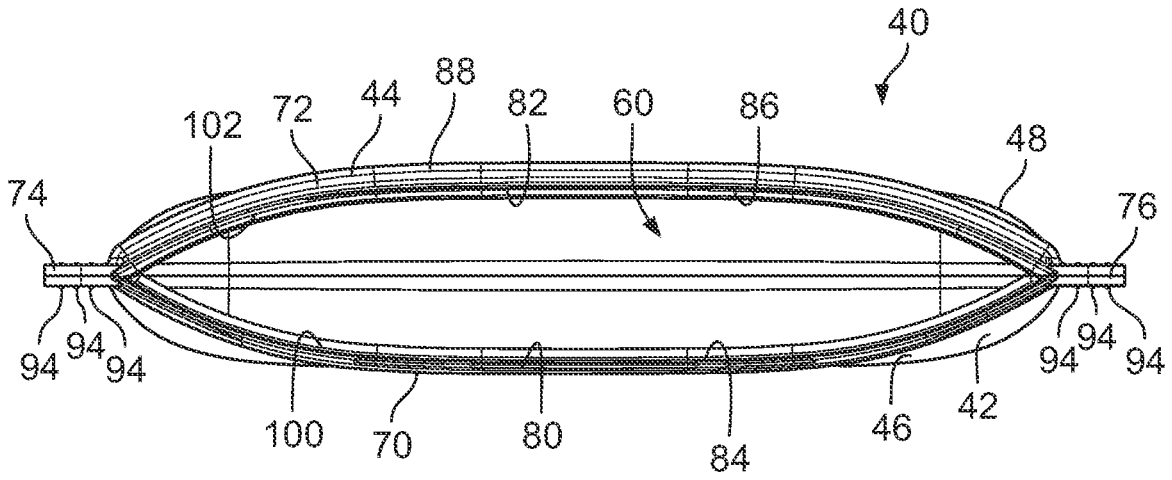
FIG. 3 is a top plan view of the pouch of FIG. 1.
Figure 4:
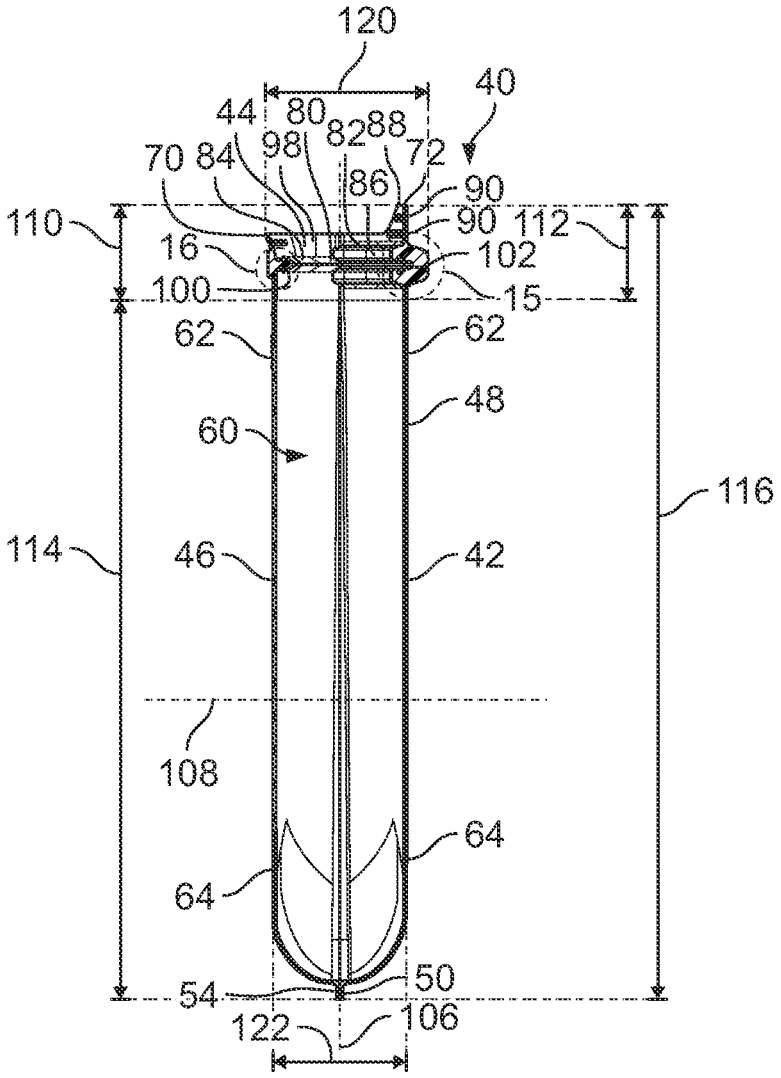
FIG. 4 is a side cross-sectional view of the pouch taken through line 4-4 of FIG. 1.

Referring to FIG. 1, the body 42 is defined by a first or front wall 46 and a second or rear wall 48, which are joined together along a peripheral edge or seam 50 that extends along a first or left side 52, a second or bottom side 54, and a third or right side 56 of the body 42. While the body 42 of the present embodiment is a unitary component, in some embodiments, the front wall 46 and the rear wall 48 may be connected by, for example, folding, heat sealing, and/or an adhesive, along the peripheral edge 50. A receptacle 60 is defined between the front wall 46 and the rear wall 48 of the body 42, which is configured for holding and retaining food or other material(s) that are placed into the receptacle 60 for storage therein. Referring to the cross-sectional view of FIG. 4 showing the pouch 40 in an open configuration, upper portions 62 of the front wall 46 and the rear wall 48 are generally straight, while lower portions 64 of the front wall 46 and the rear wall 48 are curved, and join one another at the peripheral seam 50 along the bottom side 54 of the body 42. However, in alternative embodiments, the upper portions 62 need not be straight, and the lower portions 64 need not be curved. It should be appreciated that due to the use of an elastomer to form the front wall 46 and the rear wall 48, gravity will cause the walls 46, 48 to deform or curve when the pouch 40 is placed on a resting surface (not shown).

Referring again to FIG. 1, the re-closeable pouch 40 further includes the closure system 44, which extends upwardly from the body 42. The closure system 44 includes a first or front side 70, a second or rear side 72, a first or left tab 74, and a second or right tab 76. The front side 70 comprises a front sealing strip 80 that extends longitudinally across the pouch 40, and the rear side 72 comprises a rear sealing strip 82 that also extends longitudinally across the pouch 40. The front sealing strip 80 and the rear sealing strip 82 define a closure mechanism, which includes a first or front sealing profile 84 defined by the front sealing strip 80, and a second or rear sealing profile 86 defined by the rear sealing strip 82. The front sealing strip 80 and the rear sealing strip 82 comprise the front sealing profile 84 and the rear sealing profile 86, respectively, and further include various thickened regions of the front side 70 and the rear side 72 of the closure system 44, respectively, as discussed below. Further, a handle or lip 88 is further disposed on the rear side 72, which defines a generally trapezoidal extension that extends upward from the rear sealing strip 82. The lip 88 includes a plurality of longitudinal ribs 90 disposed horizontally therealong that may assist with allowing a user to grip the lip 88 to open the pouch 40. The ribs 90 may be in the form of protrusions that extend outward from the lip 88, or grooves that extend into or through the lip 88.

Referring back to FIGS. 2 and 3, the left tab 74 and the right tab 76 of the closure system 44 are shown in greater detail. The tabs 74, 76 are disposed on left and right or opposing sides of the pouch 40, and are in the form of rounded tabs that extend outward. As will be discussed in greater detail hereinafter below with respect to FIGS. 18-23, the tabs 74, 76 are provided to allow a user to grip the pouch 40 in an ergonomic fashion to allow for better holding of the pouch 40 during use thereof. The particular location of the tabs 74, 76 along the closure system 44 and with respect to the body 42 provides an enhanced or optimized location for a user to hold the pouch 40 when removing the pouch 40 from a heated zone or when heated contents are disposed within the pouch 40. In particular, the tabs 74, 76 are not in direct thermal contact with the body 42 since the tabs 74, 76 extend outward from, and are integral with the first side 70 and second side 72, respectively. To that end, the tabs 74, 76 are placed along the pouch 40 in an optimized location, spaced a maximum distance from the contents of the receptacle 60, and thus remain cool, or relatively cooler, when handling warm or hot contents.

Through testing, it has been determined that even after being disposed within a warm or hot environment, the temperature of the tabs 74, 76 is reduced at a relatively faster rate than a temperature of contents within the receptacle 60 of the pouch 40. Since the tabs 74, 76 are disposed along distal ends of the closure system 44 of the pouch 40, the tabs 74, 76 are able to provide faster convection cooling. The tabs 74, 76 may also have features 94, which provide for enhanced heat dissipation of the tabs 74, 76 and provide extra gripping ease for the user when holding the pouch 40, as discussed in greater detail below. Functionally, the tabs 74, 76 cool down faster than the body 42 of the pouch 40, because of the increased surface area along the tabs 74, 76 alone or in conjunction with the features 94. While the present embodiment depicts heat dissipation features 94 that extend outwardly from the tabs 74, 76, the features 94 may also be provided that extend into the tabs 74, 76. The heat dissipation features 94 may include grooves, projections, or nubbins that extend outward from the tabs 74, 76, recesses or indentations that extend inward and into the tabs 74, 76, or other types of features that increase the surface area of the tabs 74, 76 and that are exposed to the surrounding environment. In some embodiments, additional materials may be applied to the tabs 74, 76 to aid in heat dissipation or gripping, such as a film, an added layer, or a material that aids in gripping and/or heat dissipation.

Referring specifically to FIG. 4, the front sealing profile 84 is disposed on the front side 70 of the closure system 44, and the rear sealing profile 86 is disposed on the rear side 72 of the closure system 44, thus, the front sealing profile 84 and the rear sealing profile 86 extend along opposing portions of an inner side 98 of the closure system 44. As shown, the front sealing profile 84 includes a male closure element 100 and the rear sealing profile 86 includes a female closure element 102 that are each unitary with the front side 70 and the rear side 72 of the closure system 44. The male closure element 100 extends inwardly from the sealing structure of the pouch 40, while the female closure element 102 includes a cavity that is defined within the rear sealing strip 82. The male closure element 100 and the female closure element 102 are aligned with respect to one another. Particular aspects of the front sealing profile 84 and the rear sealing profile 86 are discussed in greater detail with respect to FIGS. 15A-17B.

Still referring to FIG. 4, the pouch 40 defines a longitudinal axis or plane 106 that extends through the peripheral edge 50, and a horizontal axis or plane 108 that extends orthogonally through the longitudinal plane 106. Various dimensions of the pouch 40 are shown, including a height 110 of the front side 70 of the closure system 44, a height 112 of the rear side 72 of the closure system 44, a height 114 of the body 42, and a height 116 of the pouch 40. Each of the heights 110, 112, 114, 116 are measured along lines that are parallel with respect to the longitudinal plane 106. A width 120 of the closure system 44 and a width 122 of the body 42 are shown, which each define a widest measurement of the closure system 44 and body 42, respectively. While the widths 120, 122 are illustrated at a widest point of the pouch 40, thus, defining a widest width of the pouch 40 in an open configuration, the terms "width" and "height" are to be construed as a height taken at any point along each respective element of the pouch 40.

Figure 6:
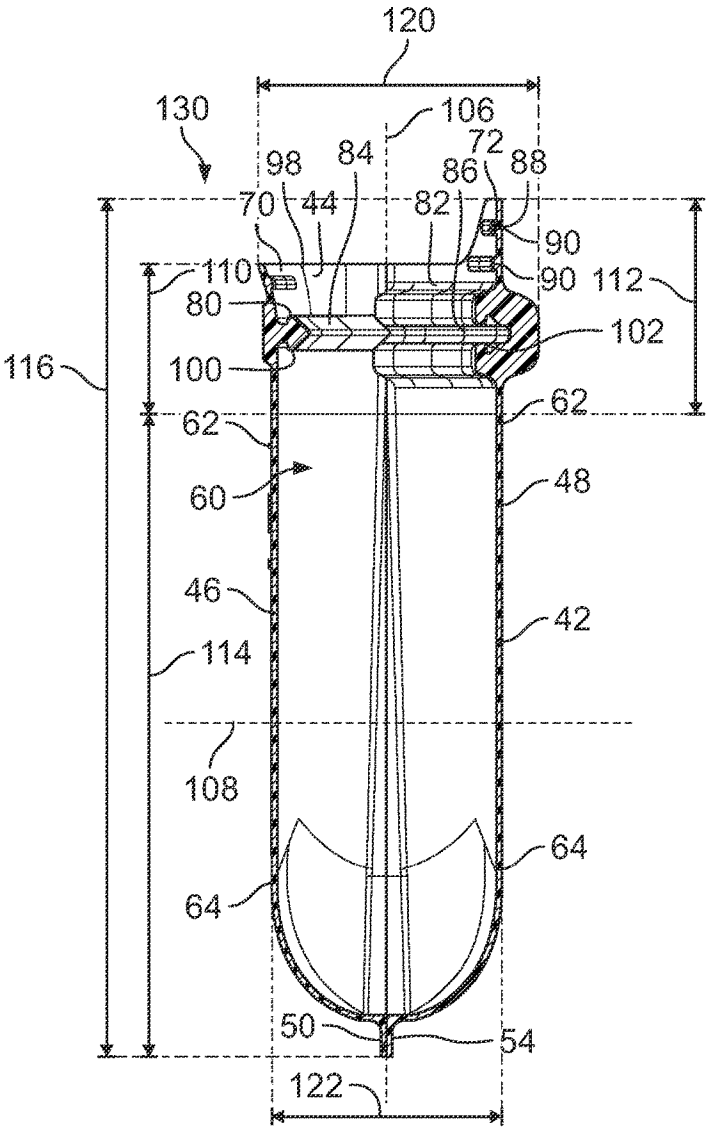
FIG. 6 is a side cross-sectional view of the pouch taken through line 6-6 of FIG. 5.
Figure 5:
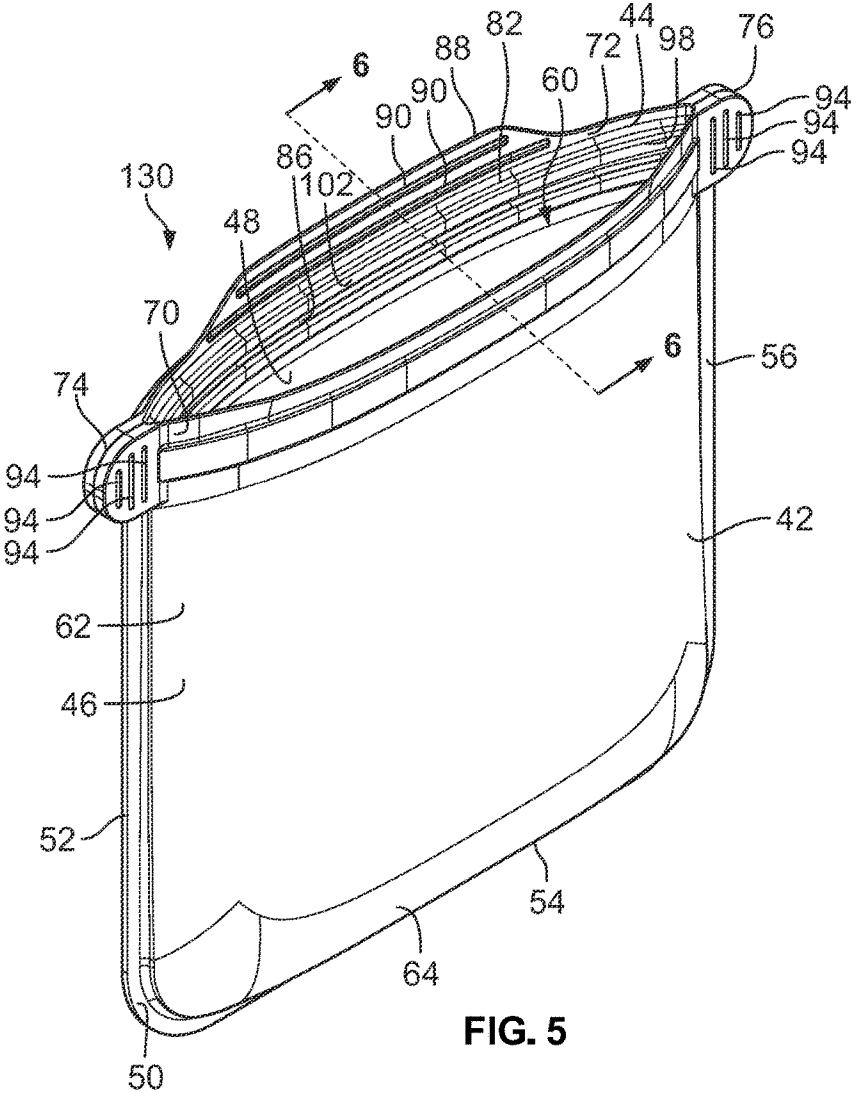
FIG. 5 is an isometric view of a second embodiment of a pouch having the closure system as disclosed herein, and shown in an open configuration.
Figure 8:
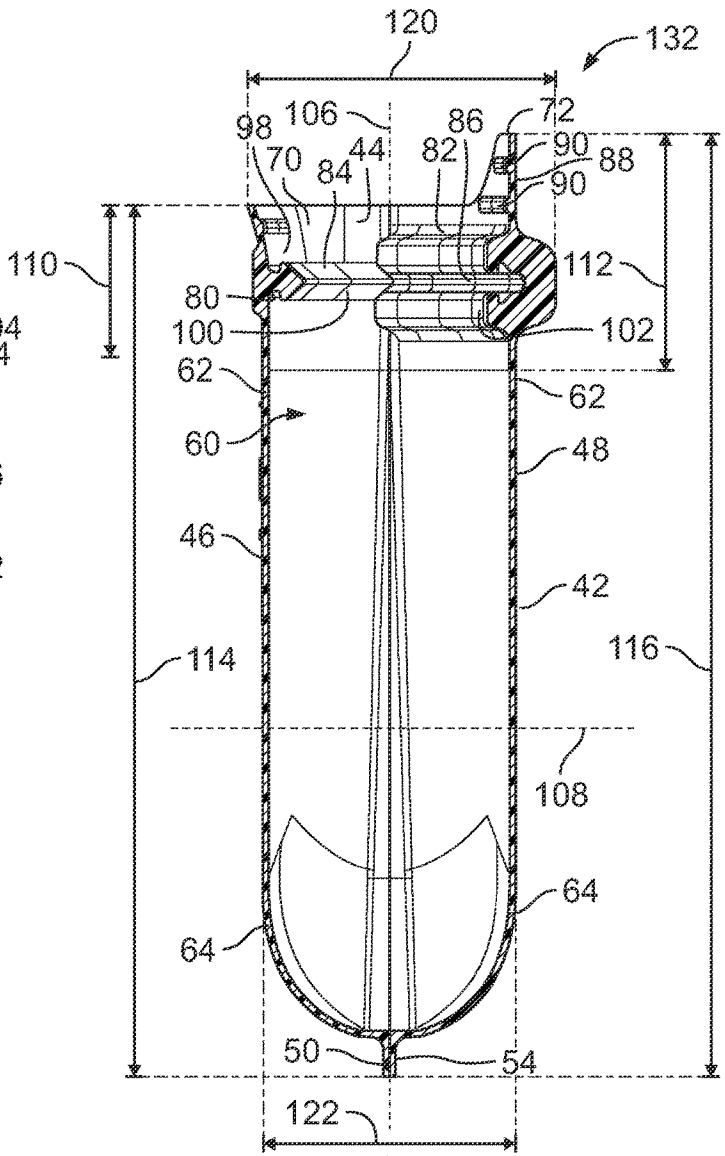
FIG. 8 is a side cross-sectional view of the pouch taken through line 8-8 of FIG. 7.
Figure 7:
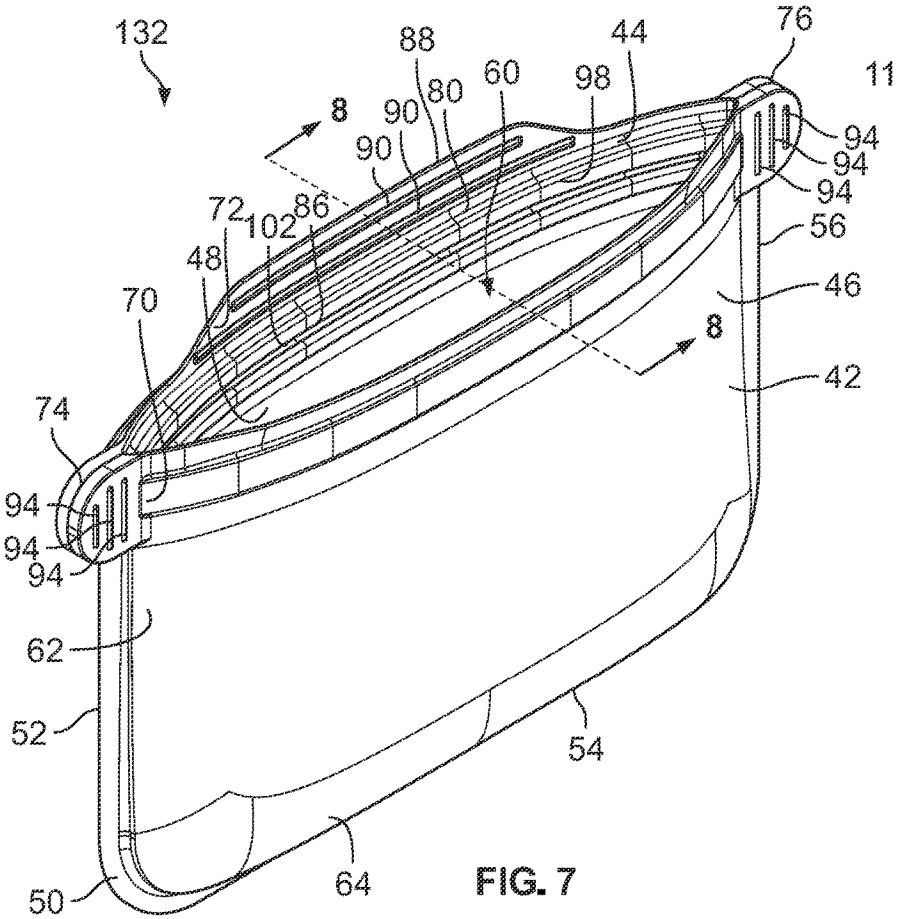
FIG. 7 is an isometric view of a third embodiment of a pouch having the closure system as disclosed herein, and shown in an open configuration.
Figure 9:
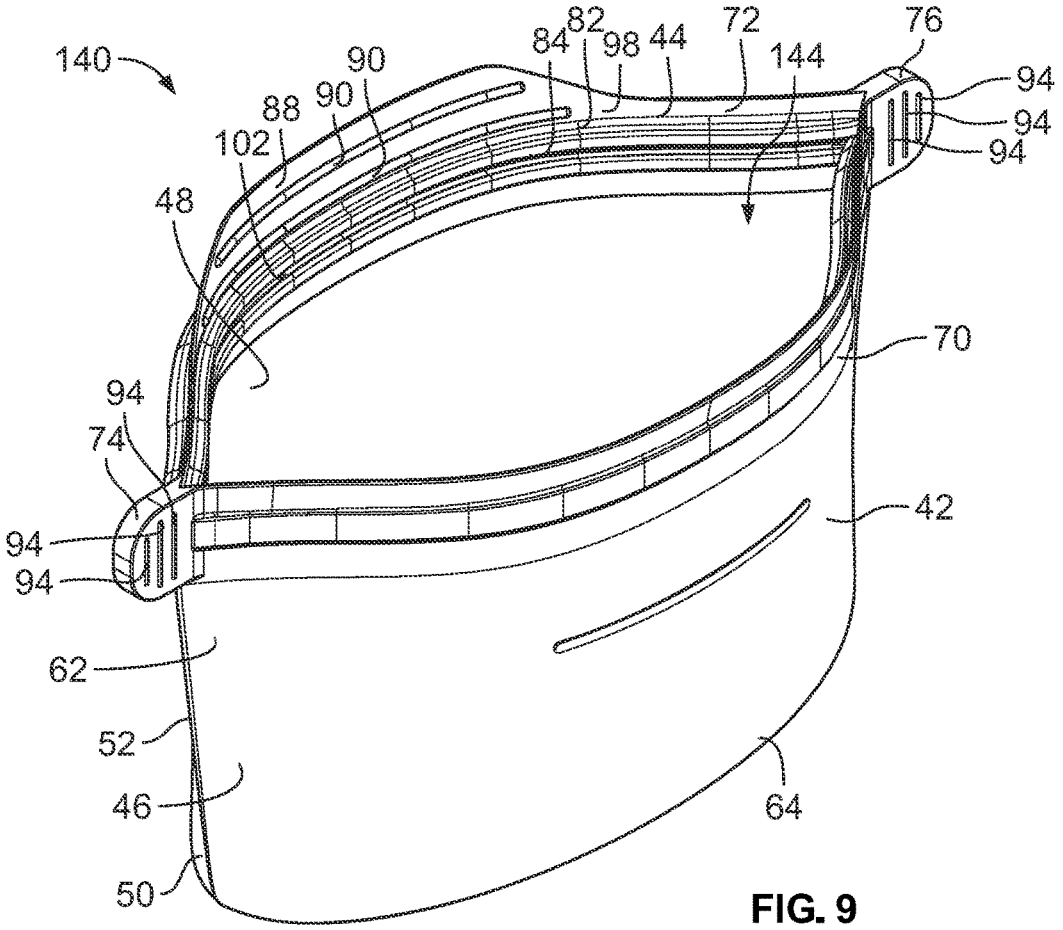
FIG. 9 is an isometric view of a first embodiment of a container having the closure system as disclosed herein, and shown in an open configuration.
Figure 10:
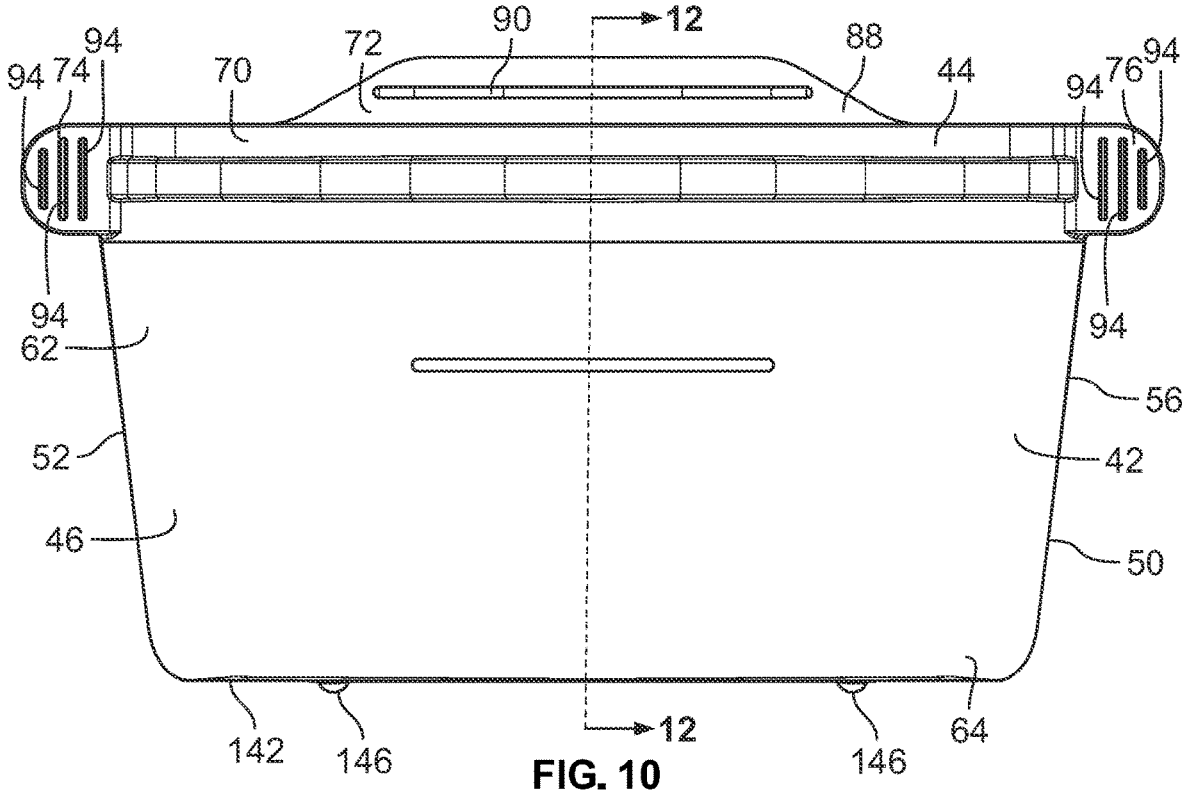
FIG. 10 is a front elevational view of the container of FIG. 9.
Figure 11:
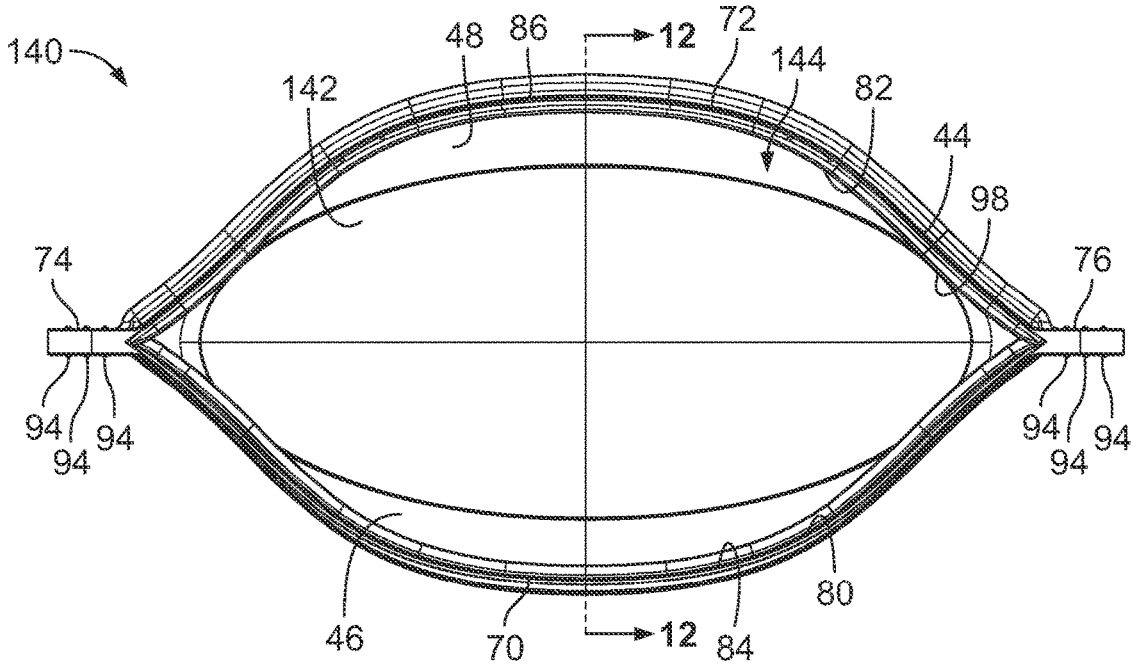
FIG. 11 is a top plan view of the container of FIG. 9.
Figure 12:
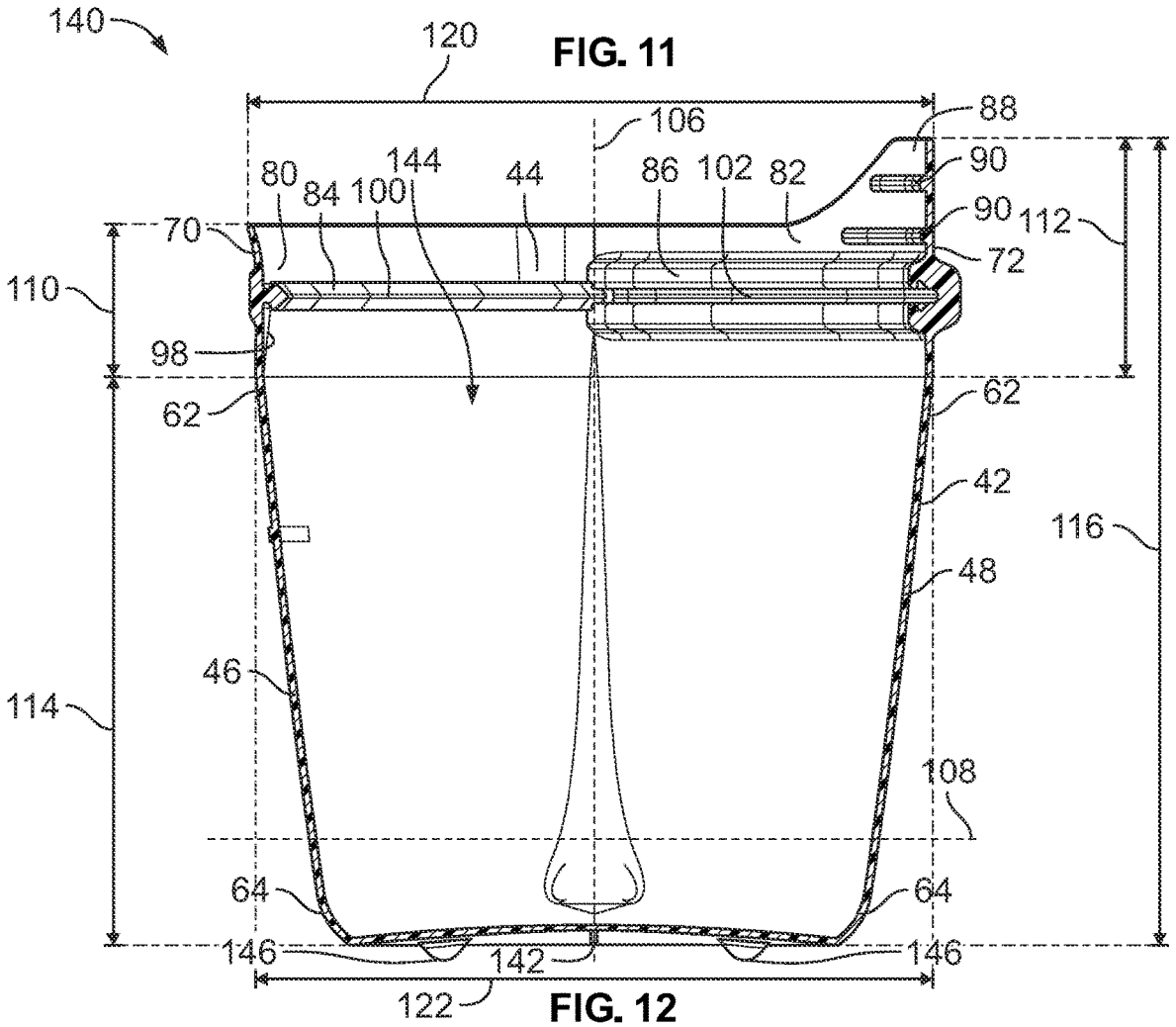
FIG. 12 is a side cross-sectional view of the container taken through line 12-12 of FIG. 9.

FIGS. 5 and 6 illustrate another embodiment of a pouch 130 having the closure system 44 and the body 42 as disclosed herein, and FIGS. 7 and 8 illustrate images of a pouch 132 having the closure system 44 and the body 42 as disclosed herein. The pouch 130 and the pouch 132 include like elements and numerals as the pouch 40 described above with respect to FIGS. 1-4. While the body 42 and the closure system 44 of the pouches 40, 130, 132 have varying heights 110, 112, 114, 116 and widths 120, 122 these differences relate to the particular capacity of the receptacles 60 and profile of the pouches 130, 132, and the desired amount of food or other material(s) that can be placed into the receptacle 60. However, the various dimensional relationships between the body 42 and the closure system 44 of the pouches 40, 130, 132 may vary within the following ranges.

The height 110 of the front side 70 of the closure system 44 may be between about 50% and about 95% of the height 112 of the rear side 72 of the closure system 44, or between about 60% and about 85% of the height 112 of the rear side 72 of the closure system 44, or between about 70% and about 80% of the height 112 of the rear side 72 of the closure system 44. Further, the height 110 of the front side 70 of the closure system 44 may be between about 5% and about 30% of the height 114 of the body 42, or between about 10% and about 25% of the height 114 of the body 42, or between about 12% and about 15% of the height 114 of the body 42. The height 110 of the front side 70 may be between about 2% and about 30% of the height 116 of the pouch 40, or between about 5% and about 25% of the height 116 of the pouch 40, or between about 7% and about 15% of the height 116 of the pouch 40. The width 120 of the closure system 44 may be between about 100% and about 140% of the width 122 of the body 42, or between about 110% and about 130% of the width 122 of the body 42, or between about 115% and about 120% of the width 122 of the body 42.

FIGS. 9-12 illustrate views of a first embodiment of a container 140 having the closure system 44 as disclosed herein. While the closure system 44 of the container 140 includes like elements and numerals as the closure system 44 of the pouches 40, 130, 132 described above, the body 42 of the container 140 also includes like elements and numerals, but is further modified to include a bottom wall 142 that is connected to the front wall 46 and the rear wall 48. As a result, the container 140 includes the front wall 46, the rear wall 48, and the bottom wall 142, which are connected to one another along the peripheral edge 50.

Figure 13:
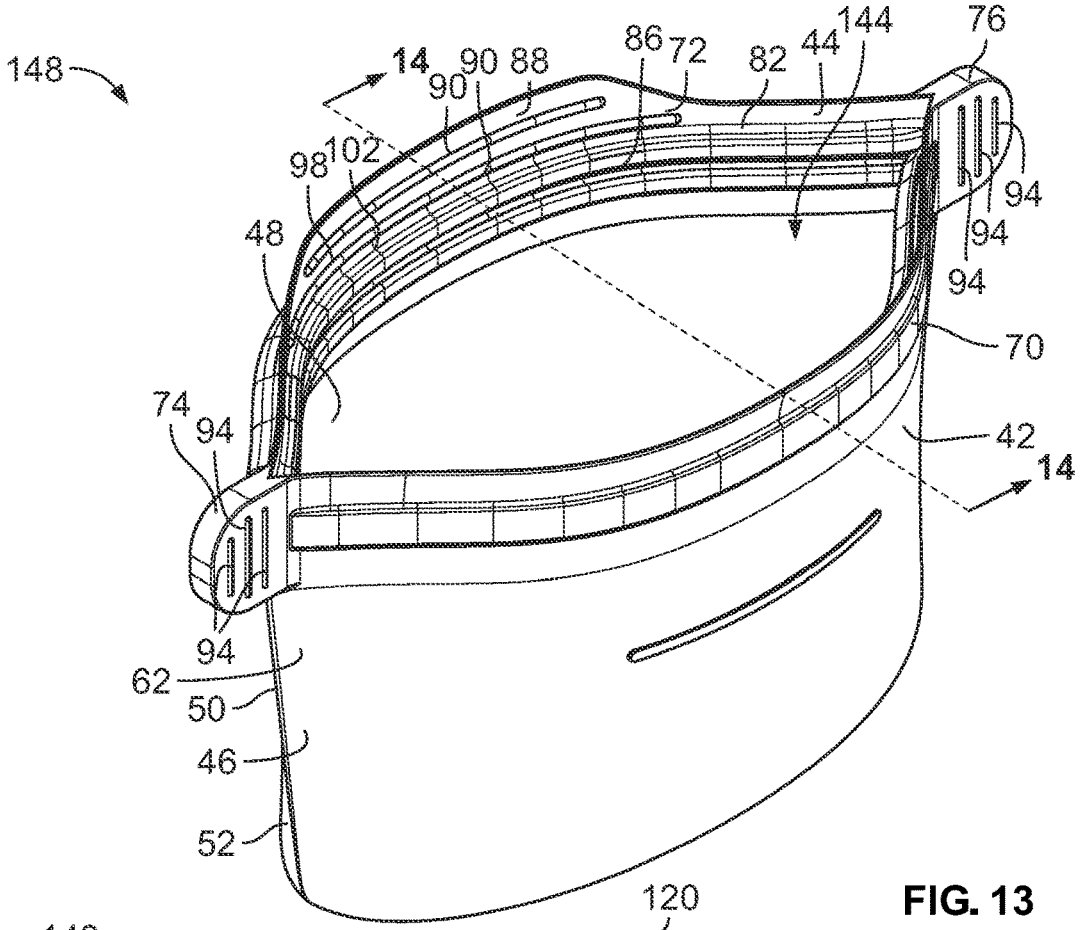
FIG. 13 is an isometric view of a second embodiment of a container having the closure system as disclosed herein, and shown in an open configuration.
Figure 14:
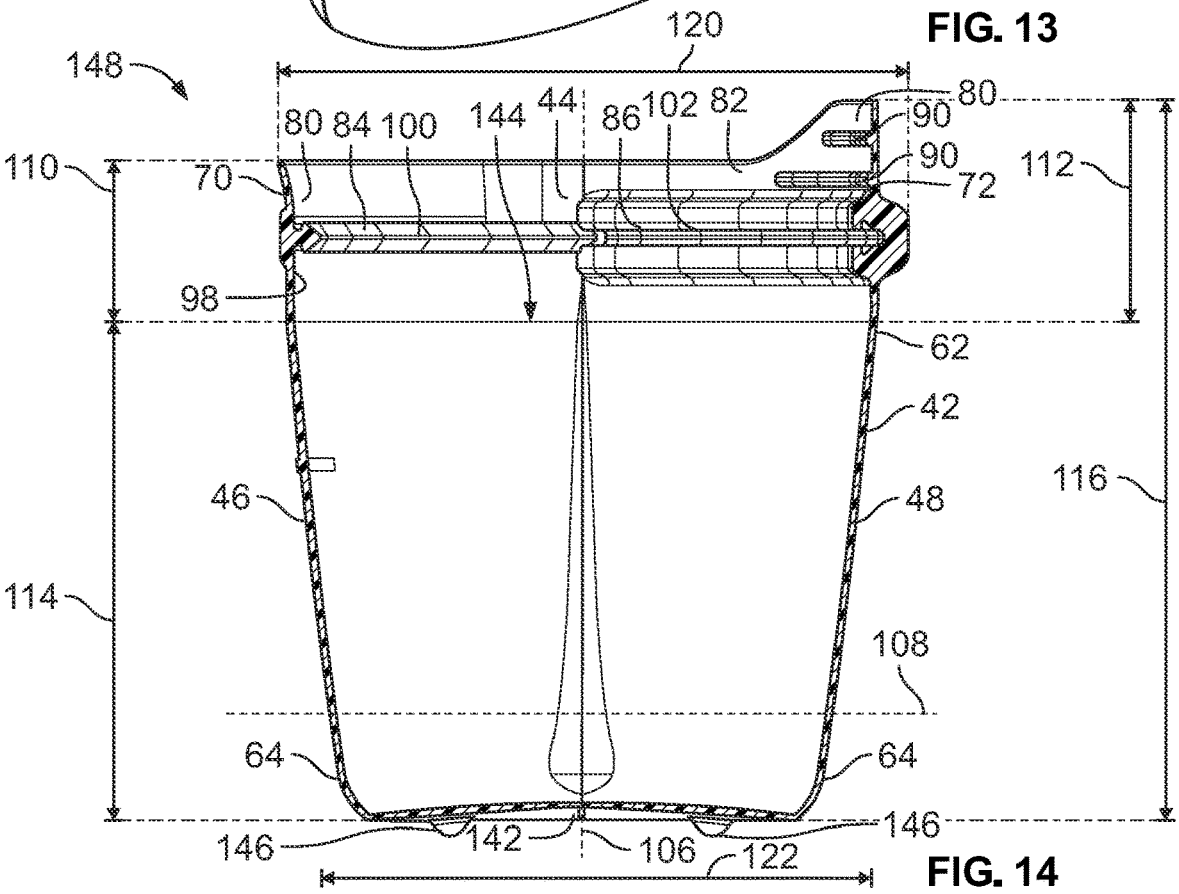
FIG. 14 is a side cross-sectional view of the container of FIG. 13.

To that end, the peripheral edge 50 includes a fourth branch, and defines intersections between the front wall 46 and the bottom wall 142, and the rear wall 48 and the bottom wall 142. The bottom wall 142 is slightly concave, and bows slightly upward, into a reservoir 144 of the container. As shown in the cross-sectional view of FIG. 12, nubbins or protrusions 146 extend downward from the bottom wall 142 for engagement with a resting surface (not shown). As such, the container 140 is capable of resting on a resting surface (not shown), and the protrusions 146 substantially prevent horizontal movement of the container 140 when resting on the resting surface. FIGS. 13 and 14 illustrate another container 148 having the closure system 44 as disclosed herein, and including a similarly configured body 42 as discussed above with respect to FIGS. 9-12. As such, like elements and numerals apply to FIGS. 13 and 14 as discussed above with respect to FIGS. 9-12. Further, the heights 110, 112, 114, 116 and widths 120, 122 and relationships between the same that are described above with respect to the pouches 40, 130, 132 also apply to the containers 140, 148.

Figure 15A:
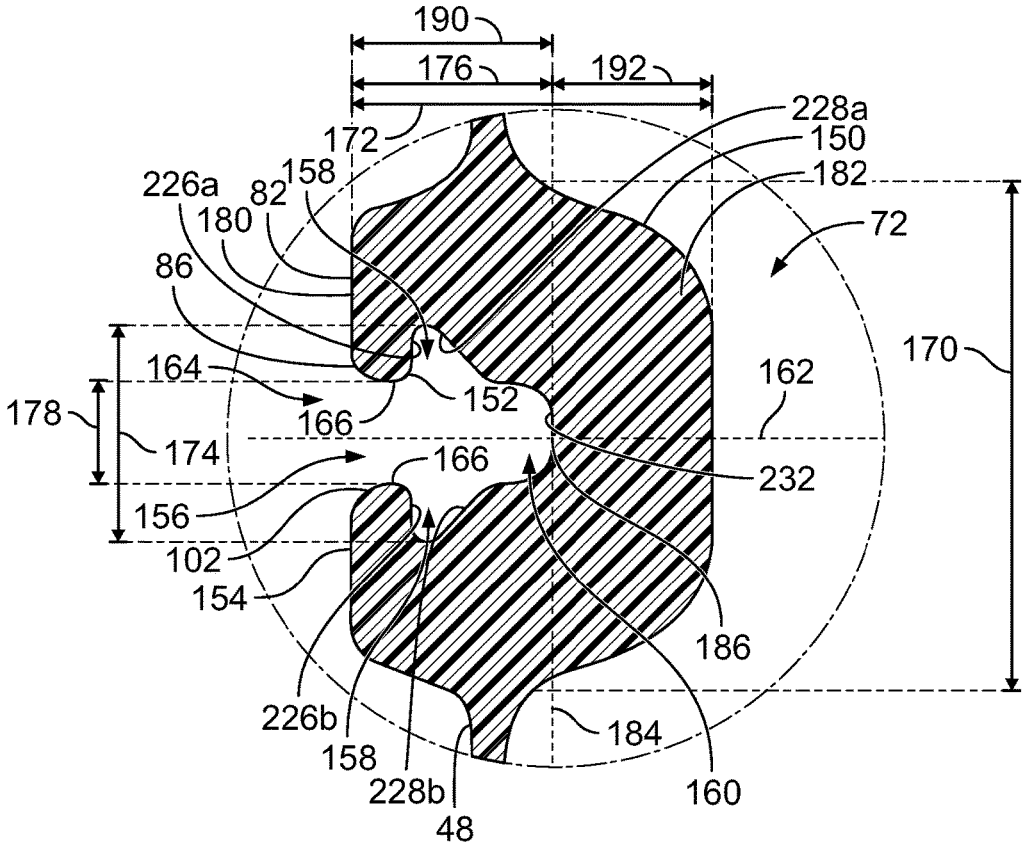
FIG. 15A is a detail view of a first female profile of the closure system of FIGS. 1-14.
Figure 16A:
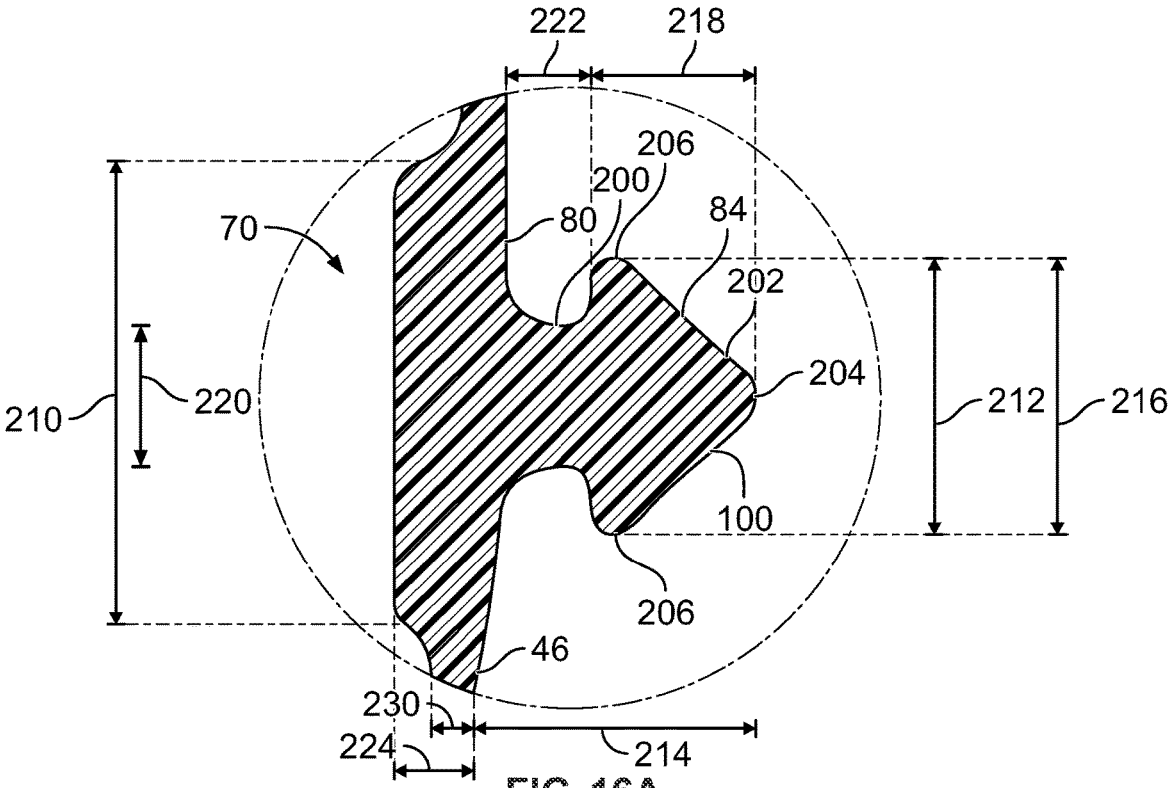
FIG. 16A is a detail view of a first male profile of the closure system of FIGS. 1-14.

Referring now to FIG. 15A, a detail view of the rear sealing profile 86 of the closure system 44 of FIGS. 1-14 is shown. In particular, the detail views of FIGS. 15A and 16A are shown with respect to the pouch 40 of FIG. 4. The rear sealing profile 86 comprises a base portion 150, an upper arm 152, and a lower arm 154 that are spaced apart from one another and extend toward one another from the base portion 150. The rear sealing profile 86 further defines a cavity 156, which is configured to receive the male closure element 100, and defines a triangular cross section with rounded inner corners 158 and a bulbous outer corner 160. The female closure element 102 is symmetrical about a longitudinal center plane or centerline 162; however, alternative a-symmetric embodiments are contemplated. The upper arm 152 and the lower arm 154 are integral with the rear sealing profile 86, and extend outwardly therefrom. The upper arm 152 and the lower arm 154 define an opening 164 into the cavity 156, into which the head of the male closure element 100 is inserted to seal the pouch 40, 130, 132 or the container 140, 148. The opening 164 is defined between distal ends 166 of the upper arm 152 and the lower arm 154. The upper arm 152 and the lower arm 154 are capable of deflecting inward or outward when the male closure element 100 is inserted into or removed from the cavity 156.

Still referring to FIG. 15A, the female closure element 102 further defines a height 170 and a thickness 172, the cavity 156 defines a height 174 and a thickness 176, and the opening 164 defines a height 178. The base portion 150 includes an inner portion 180 and an outer portion 182. The inner portion 180 is defined by a vertical line or plane 184 that extends perpendicularly through the longitudinal centerline 162 and through an innermost point 186 along the surface defining the cavity 156. As such, the inner portion 180 includes the entire cavity 156, while the outer portion 182 does not include any portion of the cavity 156. The inner portion 180 further defines a thickness 190, which is measured in a direction parallel with respect to the centerline 162, and the outer portion 182 defines a thickness 192, measured in a direction parallel with respect to the centerline 162.

The thickness 192 of the outer portion 182 is between about 3.0 millimeters (mm) and about 6.0 mm, or between about 3.5 mm and about 5.5 mm, or between about 4.0 mm and about 5.0 mm. In some embodiments, the male closure element 100 defines a thickness of less than about 7.0 mm, or less than about 6.5 mm, or less than about 6.0 mm, or less than about 5.5 mm, or less than about 5.0 mm, or less than about 4.5 mm, or less than about 4.0 mm, or less than about 3.5 mm, or less than about 3.0 mm, or less than about 2.5 mm, or less than about 2.0 mm.

FIG. 16A is a detail view of the male closure element 100 of the closure system 44 of FIGS. 1-14. The male closure element 100 comprises a stem portion 200 that extends outward from the male closure system 44 and joins a head portion 202. The head portion 202 defines an outer corner 204 and inner corners 206 that are disposed in a triangular configuration. The head portion 202 and the stem 200 are unitary components with the male closure system 44. The male closure system 44 defines a thickened region 208, which defines a height 210. The male closure element 100 defines a height 212 and a thickness 214, the head portion 202 of the male closure element 100 defines a height 216 and a thickness 218, the stem 200 defines a height 220 and a thickness 222, and the thickened region 208 defines a thickness 224.

Referring again to FIG. 15A, the thickness 192 of the outer portion 182 is between about 20% and about 180% of the thickness 190 of the inner portion 180, or between about 50% and about 150% of the thickness 190 of the inner portion 180, or between about 80% and about 120% of the thickness 190 of the inner portion 180. In some embodiments, the thickness 192 is at least 20% of the thickness 190 of the inner portion 180, or at least 30%, or at least 40%, or at least 50%, or at least 60%, or at least 70%, or at least 80%, or at least 90%, or at least 100%, or at least 110%, or at least 120%, or at least 130%, or at least 140%, or at least 150%, or at least 160%, or at least 170%, or at least 180%, or at least 190%, or at least 200%, or at least 250%, or at least 300%, or at least 350%, or at least 400% of the thickness 190 of the inner portion 180. The thickness 192 of the outer portion 182 is between about 20% and about 80% of the thickness 172 of the female closure element 102, or between about 30% and about 70% of the thickness 172 of the female closure element 102, or between about 40% and about 60% of the thickness 172 of the female closure element 102.

Still referring to FIG. 15A, the cavity 156 is at least partially defined by inner surfaces 226*a*, 226*b*, which define inner surfaces of the upper arm 152 and the lower arm 154, respectively. The inner surfaces 226*a*, 226*b* also partially define the corners 158. The inner surfaces 226*a*, 226*b* may be defined as sealing surfaces, as these surfaces align with portions of the male sealing element 100 to provide an enhanced seal. The cavity 156 is also at least partially defined by lateral surfaces 228*a*, 228*b*, which at least partially define a profile of the male sealing element 100, i.e., the lateral surfaces 228*a*, 228*b* are angled inward from intersections with the inner surfaces 226*a*, 226*b* toward the plane 162. Finally, an outer surface 232 defines an innermost surface of the cavity 156, and in the present embodiment, the outer surface 232 defines the bulbous outer corner 160. In the present embodiment, the outer surface 232 does not follow a profile of the male sealing element 100, and may be disposed in a variety of configurations. It is contemplated that one or more of the outer surface 232, lateral surface 228*a*, and lateral surface 228*b* may not follow the profile of the male sealing element 100 in other embodiments, as described below with respect to FIGS. 15B, 16B, and 17B. In the present embodiments, surfaces that do not follow a corresponding profile portion can be considered to have different shapes or curvatures defining the respective surfaces, i.e., they do not mirror one another or have profiles that substantially conform with one another.

Referring again to FIG. 16A, the height 216 of the head component 202 is greater than the height 220 of the stem 200. Further, the thickness 224 of the thickened region 208 is between about 10% and about 60% of the thickness 214 of the male closure element 100, or between about 20% and about 50% of the thickness 214 of the male closure element 100, or at least 10%, or at least 20%, or at least 30%, or at least 40%, or at least 50% of the thickness 214 of the male closure element 100. Further a thickness 230 of the rear wall 48 is between about 20% and about 80% the thickness 224 of the thickened region 208, or between about 30% and about 70% of the thickness 224 of the thickened region 208, or between about 40% and about 60% of the thickness 224 of the thickened region 208, or about 50% of the thickness 224 of the thickened region 208.

Figure 17A:
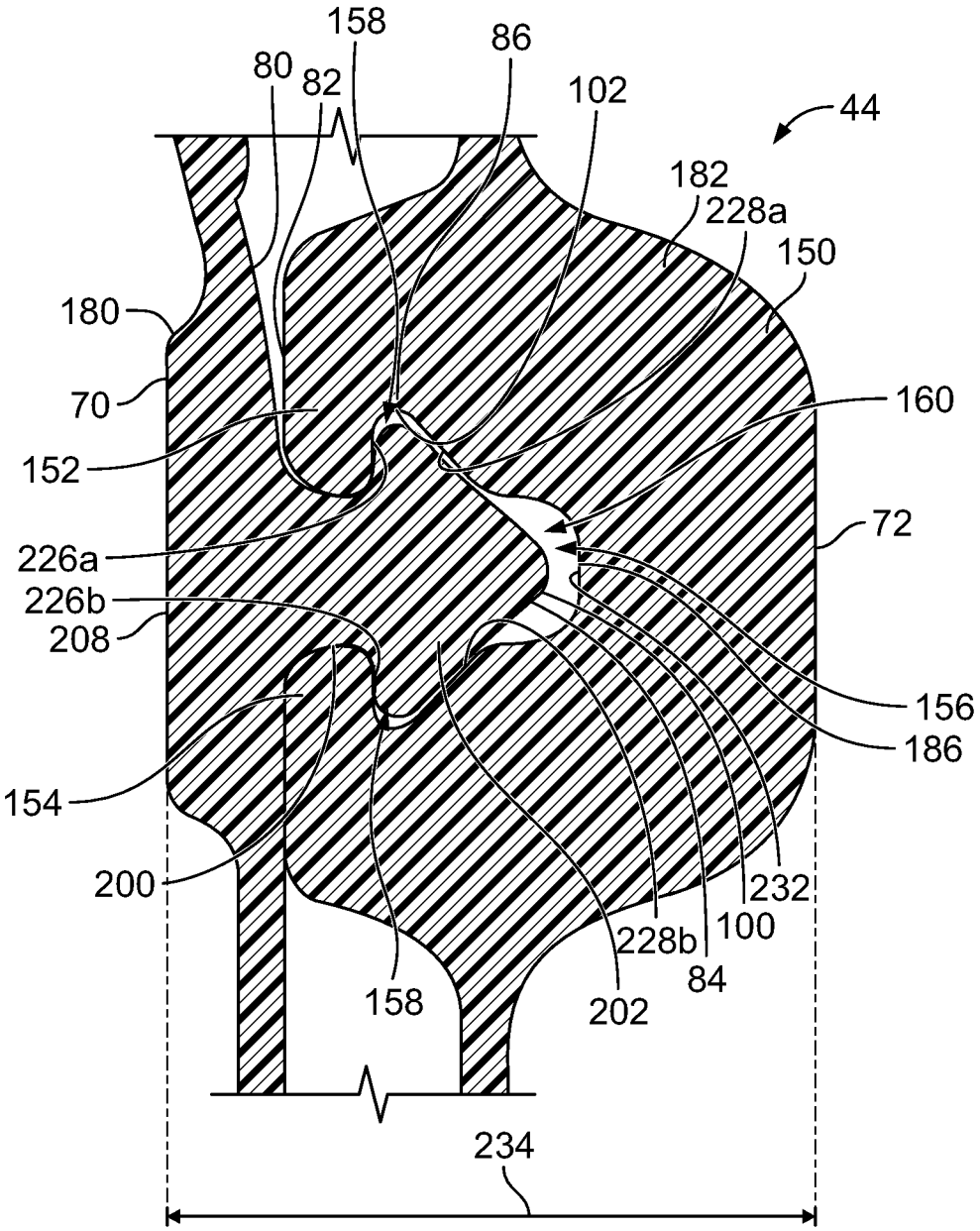
FIG. 17A is a detail view of the first male and female profiles of FIGS. 15A and 16A in a closed configuration.

Referring to FIGS. 15A and 16A in combination, the height 220 of the stem 200 is between about 100% and about 500% of the height 178 of the opening 164, or between about 150% and about 400% of the height 178 of the opening 164, or between about 200% and about 300% of the height 178 of the opening 164, or at least 100%, or at least 125%, or at least 150%, or at least 175%, or at least 200%, or at least 250%, or at least 300%, or at least 350%, or at least 400%, or at least 450% of the height 178 of the opening 164. FIG. 17A is a detail view of the first and second profiles 84, 86 of FIGS. 15A and 16A in a closed configuration. In the closed configuration, the closure system 44 defines a total thickness 234. Referring to FIGS. 15A and 17A, the thickness 192 of the outer portion 182 is between about 10% and about 90% of the total thickness 234, or between about 20% and about 80% of the total thickness 234, or between about 30% and about 70% of the total thickness 234, or between about 35% and about 50% of the total thickness 234, or at least 10%, or at least 20%, or at least 30%, or at least 40%, or at least 50%, or at least 60%, or at least 70% of the total thickness 234.

Still further, in some embodiments the thickness 224 of the thickened region 208 is less than 35% of the total thickness 234 of the closure system 44, or less than 30% of the total thickness 234 of the closure system 44, or less than 25% of the total thickness 234 of the closure system 44, or less than 20% of the total thickness 234 of the closure system 44. In some embodiments, the height 220 of the stem 200 is between about 10% and about 50% of the height 170 of the female closure element 102, or between about 20% and about 40% of the height 170 of the female closure element 102, or between about 25% and about 35% of the height 170 of the female closure element 102, or less than 50%, or less than 40%, or less than 30%, or less than 20% of the height 170 of the female closure element 102.

Through testing, it has been determined that an enhanced sealing structure is achieved when the thickness 192 of the outer portion 182 is at least 30% of the thickness 172 of the female closure element 102. Desirable results were achieved through testing up to and including when the thickness 172 of the female closure element 102 is 80% of the thickness 172 of the female closure element 102. When the thickness 192 of the outer portion 182 is thicker, a stiffness of the female closure element 102 is achieved that allows the upper arm 152 and lower arm 154 to deflect inward and outward without causing the base portion 150 of the female closure element 102 to deflect backward along the centerline or plane 162.

Still further, it was determined through testing that having the stem 200 with a height 220 that is at least the same as the height 178 of the opening 164 provides for enhanced sealing of the closure system 44. To that end, the opening 164 is preferably smaller than the stem 200. It is preferable to require between about 3 pounds force (lbf) and about 10 lbf to open and close the closure system 44. In some embodiments, between about 3 lbf and about 20 lbf is required, or between about 5 lbf and about 15 lbf, or between about 7 lbf and about 12 lbf. The closure system 44 is generally considered desirable for use if it can hold the volume of receptacle 60 ¾ full of water when the pouch or container is upside down. This feature is achieved by the design of the arms 152, 154 of the female closure element 102 and the rounded corners 206 of the male head portion 202. The outer corner 204 of the head portion 202 controls the force required for the contents to fall out of the pouch or container when in the closed configuration, while the inner corners 206 of the head portion 202 controls the force required to open and close the closure system 44.

Figure 15B:
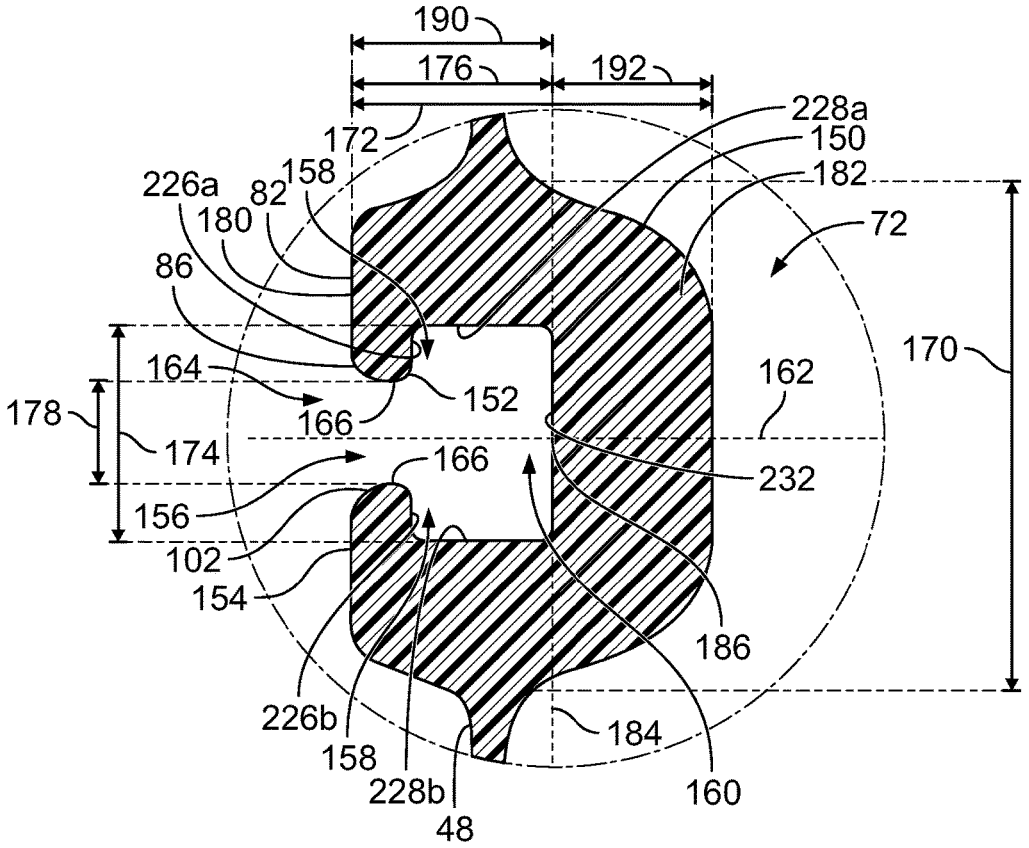
FIG. 15B is a detail view of a second female profile of the closure system of FIGS. 1-14.
Figure 16B:
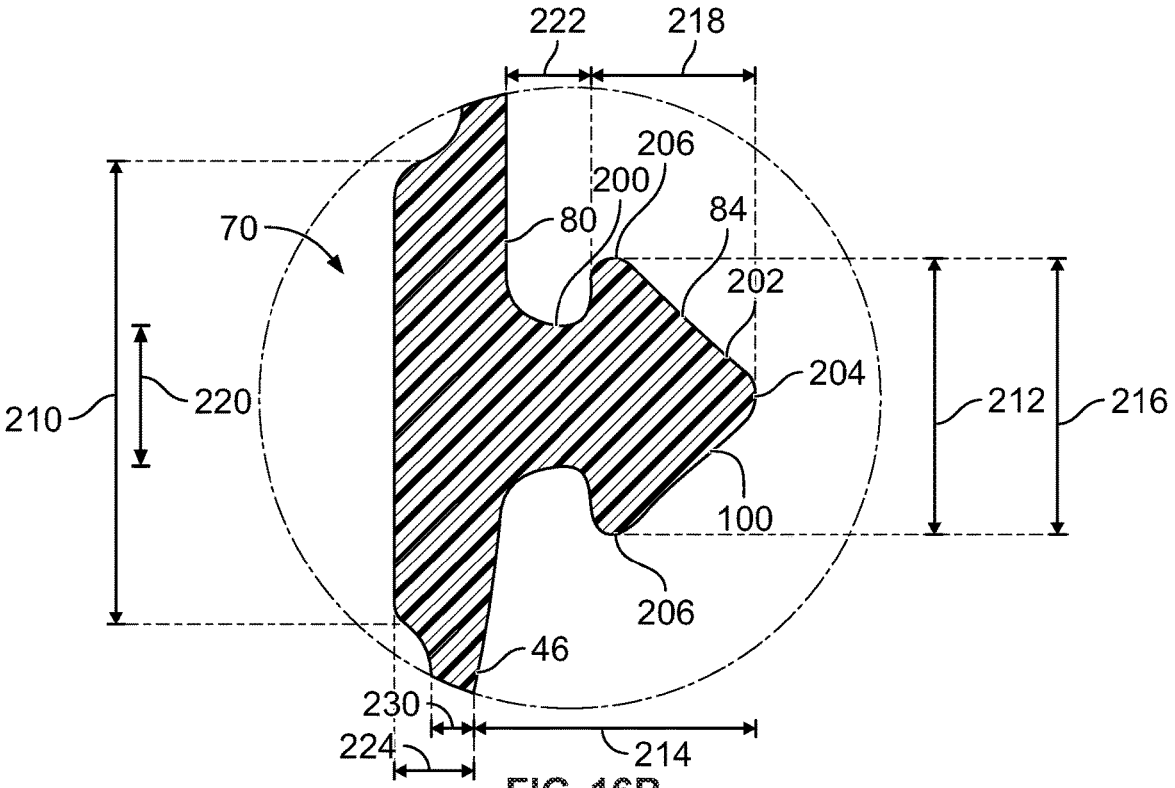
FIG. 16B is a detail view of a second male profile of the closure system of FIGS. 1-14.
Figure 17B:
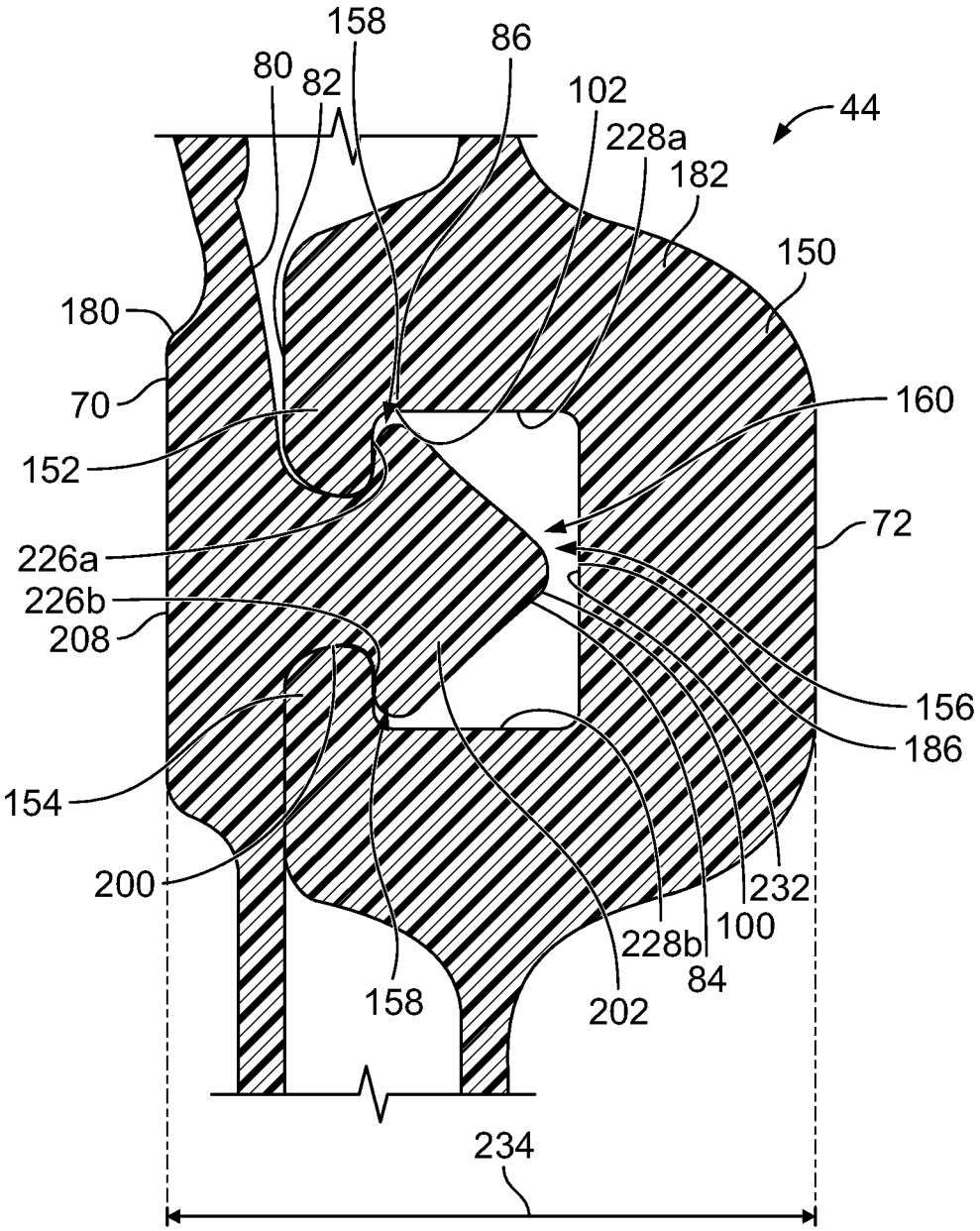
FIG. 17B is a detail view of the second male and female profiles of FIGS. 15B and 16B in a closed configuration.

Referring now to FIGS. 15B, 16B, and 17B, a second configuration of the sealing structure is shown, in which the male closure element 100 is identical to the male closure element 100 of FIG. 16A, but the female closure element 102 includes a cavity 156 that defines a rounded rectangular cross-section rather than the profile as shown in FIGS. 15A and 17A. Referring to FIG. 15B, the upper arm 152 and the lower arm 154 define the opening 164 into the cavity 156, into which the head of the male closure element 100 is inserted to seal the pouch 40, 130, 132 or the container 140, 148. The opening 164 is defined between distal ends 166 of the upper arm 152 and the lower arm 154 in a similar fashion as described above with respect to FIG. 15A, and the upper arm 152 and the lower arm 154 are capable of deflecting inward or outward when the male closure element 100 is inserted into or removed from the cavity 156. As shown in FIG. 15B, the cavity 156 is larger than the cavity of FIG. 15A, and does not define a profile that follows the contour of the male closure element 100. To that end, the cavity 156 may define a variety of shapes, and need not follow the profile of the male closure element 100.

Referring specifically to FIG. 15B, the cavity 156 is at least partially defined by the inner surfaces 226*a*, 226*b*, which define inner surfaces of the upper arm 152 and the lower arm 154, respectively. The inner surfaces 226*a*, 226*b* also partially define the corners 158. As noted above, the inner surfaces 226*a*, 226*b* may be defined as sealing surfaces, as these surfaces align with portions of the male sealing element 100 to provide an enhanced seal. The cavity 156 is also at least partially defined by the lateral surfaces 228*a*, 228*b*, which in the present embodiment extend horizontally from the inner surfaces 226*a*, 226*b* in a direction that is parallel with respect to the plane 162. The outer surface 232 is also depicted, which defines an innermost surface of the cavity 156. In the present embodiment, the lateral surfaces 228*a*, 228*b* do not follow a profile of the male sealing element 100.

In the present embodiment, the outer surface 232 is disposed orthogonally with respect to the plane 162, but the outer surface 232 may be curved, or may define alternative configurations. In some embodiments, more or fewer surfaces may be included. For example, the cavity 156 may be defined by the inner surfaces 226*a*, 226*b*, and a generally circular outer surface (not shown) that extends from outermost points of the inner surfaces 226*a*, 226*b*. To that end, the cavity 156 may define a variety of cross-sectional areas, and may be in the shape of a square, a rectangle, a triangle, a hexagon, etc. In some embodiments, multiple sub-cavities may be defined by the various surfaces that define the cavity 156 such that multiple compartments are formed that receive the male sealing element 100. In some embodiments, the cavity 156 may not be defined by the lateral surfaces 228*a*, 228*b*, and may instead only include the outer surface 232 which may extend from intersections with the inner surfaces 226*a*, 226*b*, i.e., to define a circular or semi-circular cross section.

The foregoing provides an enhanced sealing structure that includes an asymmetrically thickened profile along the female closure element 102, i.e., the outer portion 182, which allows for minimizing materials so that both the inner portion 180 and the outer portion 182 of the female closure element 102 are not thick. This creates a thinner profile, which is more desirable for a user, and more cost effective to manufacture by using less material. A functional benefit is also achieved in that when the male closure element 100 is inserted into the female closure element 102, as shown in FIG. 17A, insertion of the male closure element 100 creates a bending force that causes the arms 152, 154 of the female closure element 102 to flex open. That flexure causes the outer portion 182 of the base portion 150 to bend and pivot backward along the centerline 162, and create a V-shape. Without a sufficient thickness 192 of the outer portion 182, it has been found through testing that the step of closing may fail or become more cumbersome for a user, since the user needs to press back and pivot close the female closure element 102. Furthermore, the height 220 of the stem 200 is at least 100% of the height 178 of the opening 164, which has been found to be a critical limit that provides sufficient sealing and proper resiliency to adequately open and close the closure system 44. These features, alone or in combination, achieve an enhanced closure system 44 that provides functional benefits to a user, and provides for an enhanced seal.

Figure 18:
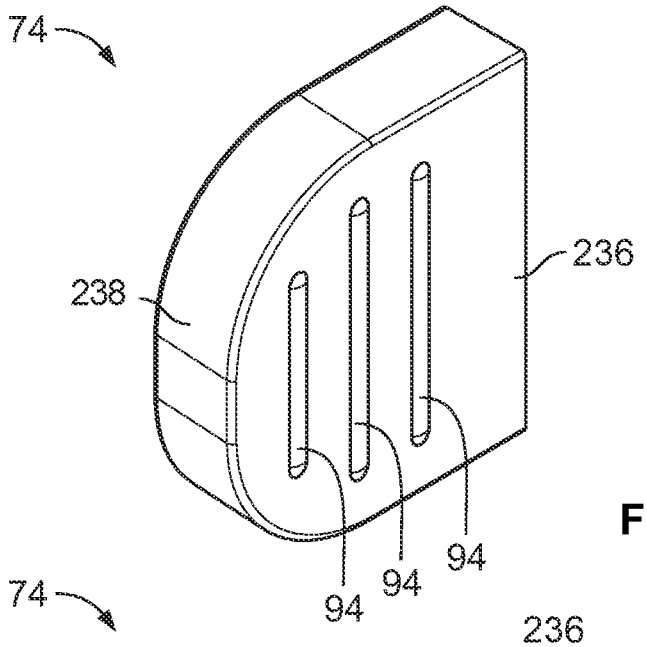
FIG. 18 is an isometric view of a first embodiment of a tab of the closure system of FIGS. 1-14.
Figure 19:
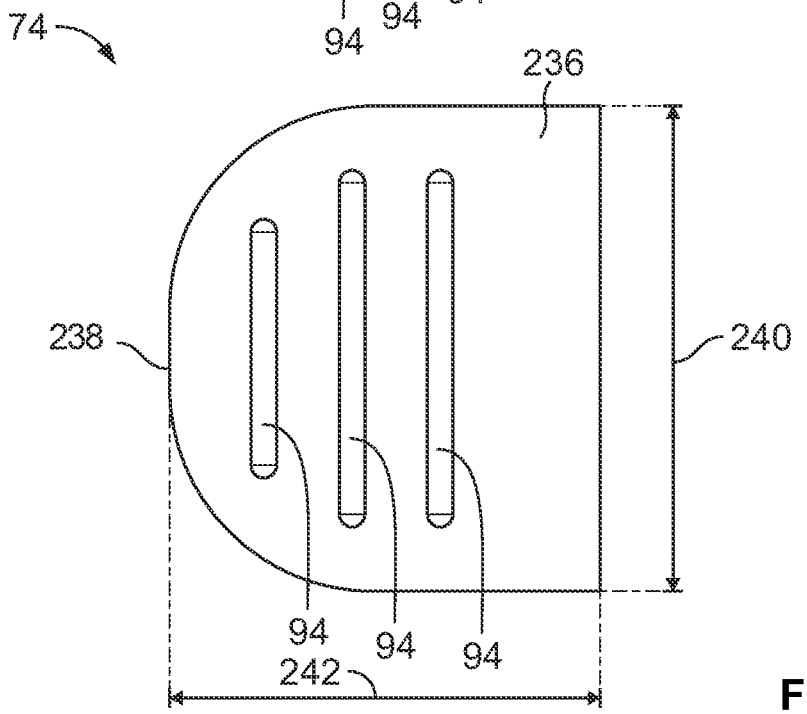
FIG. 19 is a front elevational view of the tab of FIG. 18.
Figure 20:
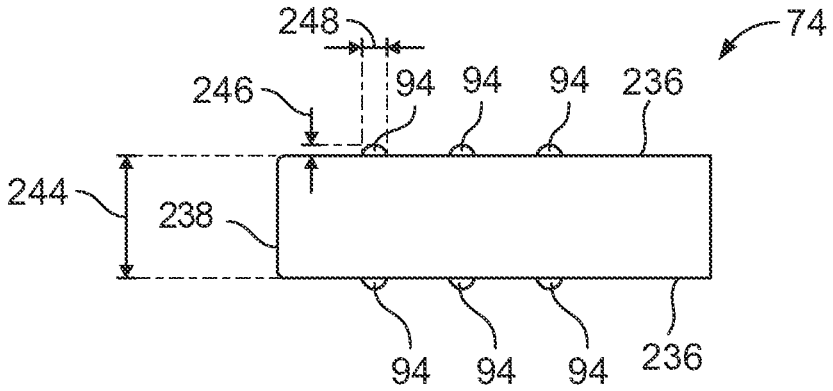
FIG. 20 is a top plan view of the tab of FIG. 18.

Referring to FIGS. 18-20, one of the tabs 74, 76 is shown in detail. While only a single one of the tabs 74, 76 is shown, it is to be appreciated that the illustrated tab 74 represents both of the tabs 74, 76, and that the following description applies to each of the tabs 74, 76 discussed above. As discussed above, the tabs 74, 76 are disposed at opposing ends of the closure system 44, and provide a user with an optimized experience when holding the pouches 40, 130, 132 or containers 140, 148 when in use. The tabs 74, 76 are designed to cool faster than the body 42 of the pouches 40, 130, 132 and containers 140, 148. The features 94 are disposed along the tab 74, which aid in both increasing the surface area along the tab 74, to achieve increased cooling, and in grasping the tabs 74, 76. The degree to which cooling is desired may be tuned by increasing or decreasing the size and number of grooves to adjust the total exposed surface area.

While the features 94 are shown in a vertical orientation, it is contemplated that the features 94 may be angled, parallel, or may intersect. Further, while in the present embodiment the features 94 extend outwardly from the tabs 74, 76 in the form of projections, it is also contemplated that recesses or grooves may be similarly provided in the tabs 74, 76. To that end, one or more of a protrusion, a recess, or a nubbin may be provided. Still further, in some embodiments, the features 94 may be provided so that they extend out from the tabs 74, 76 in combination with grooves that extend into the tabs 74, 76. In some embodiments, the features 94 along the left tab 74 may define a first configuration, i.e., the configuration shown in FIGS. 18-20, and the features 94 along the right tab 76 may define a second configuration that is different than the first configuration, i.e., the configurations along the tabs 74, 76 may be different. In some embodiments, the features 94 extend from opposing first and second sides 236 of the tabs 74, 76, as shown in FIGS. 18-20, and in other embodiments, the features 94 may extend from a peripheral side 238 of the tabs 74, 76. While three of the features 94 are shown extending from each of the sides 236 of the tab 74, it is contemplated that the features 94 may extend from only one of the opposing sides 236.

Referring specifically to FIG. 19, the tab 74 defines a height 240 and a width 242. The height 240 is between about 10 mm and about 40 mm, or between about 15 mm and about 30 mm, or between about 20 mm and about 30 mm, or about 24 mm. In some embodiments, the width 242 is between about 5 mm and about 30 mm, or between about 10 mm and about 25 mm, or between about 15 mm and about 20 mm, or about 18 mm. Referring to FIG. 20, the tab 74 defines a thickness 244. The thickness 244 of the tab 74 is between about 0.5 mm and about 11.0 mm, or between about 3.0 mm and about 9.0 mm, or between about 4.0 and about 7.0 mm, or about 6.0 mm. The features 94 each define a thickness 246 and a width 248, which is identical in the present embodiment. However, it is contemplated that the features 94 may define varying thicknesses, and may be disposed in alternative configurations. In the present embodiment, the thickness 246 of the features 94 is between about 0.1 mm and about 1.0 mm, or between about 0.3 mm and about 0.7 mm, or about 0.5 mm. Further, the width 248 is between about 0.2 mm and about 2.0 mm, or between about 0.8 mm and about 1.4 mm, or about 1.2 mm.

Figure 21:
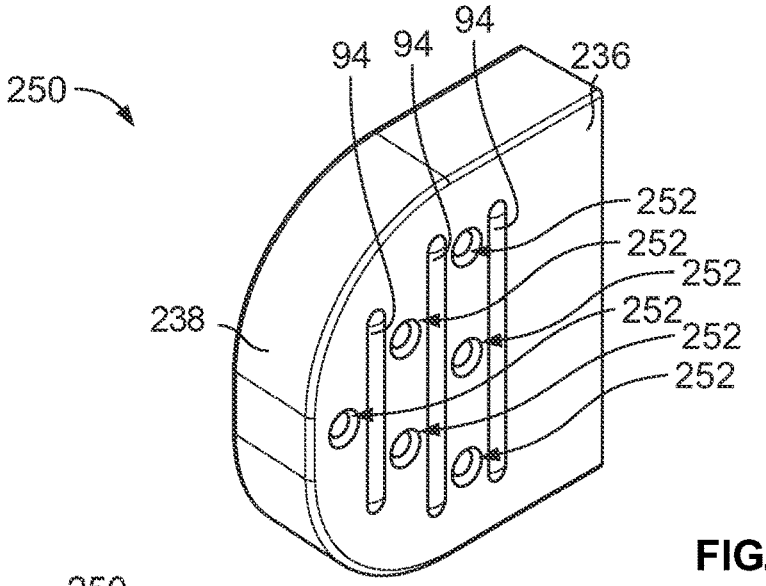
FIG. 21 is an isometric view of another embodiment of a tab of the closure system of FIGS. 1-14.
Figure 22:
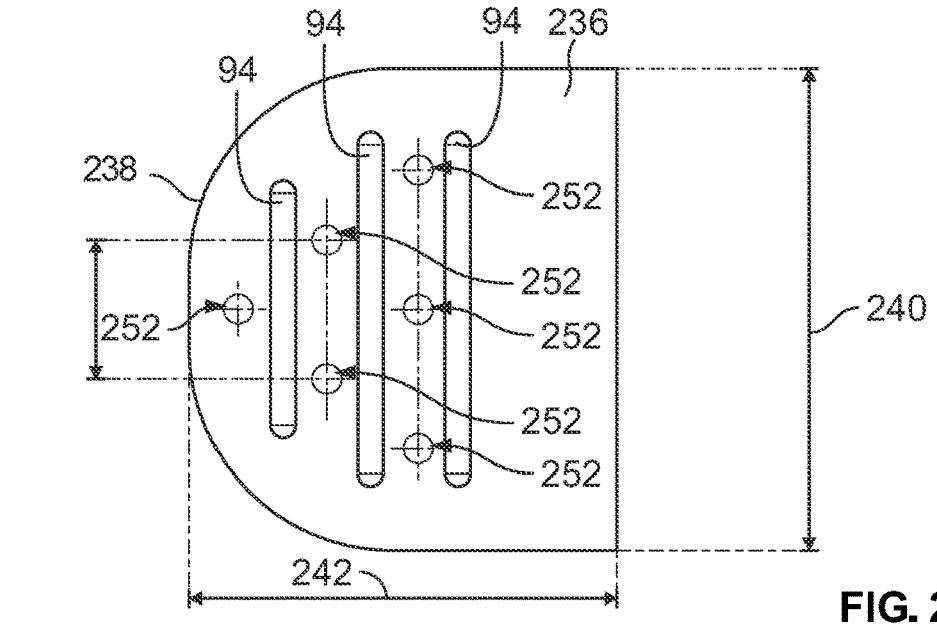
FIG. 22 is a front elevational view of the tab of FIG. 21.
Figure 23:
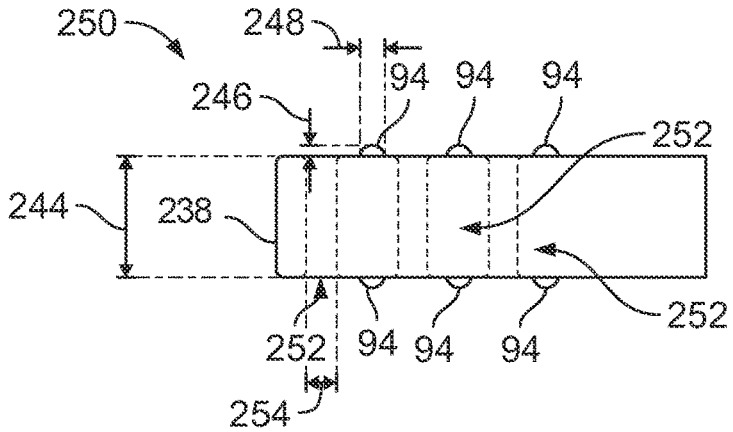
FIG. 23 is a top plan view of the tab of FIG. 21.

Referring to FIGS. 21-23, another tab 250 is shown, which is similar to the tabs 74, 76 discussed above. The tab 250 includes a plurality of holes or apertures 252, which provide for increased cooling since the apertures 252 increase the surface area of the tab 250 that is exposed the surrounding atmosphere. The degree to which cooling is desired may be tuned by increasing or decreasing the number of apertures to adjust the total exposed surface area. The features 94 are further included, which result in the benefits described above. In some embodiments, the tab 250 includes convex features 94 and a plurality of the apertures 252. The apertures 252 may define a diameter 254 of between about 0.5 millimeters (mm) and about 4.5 mm, or between about 1.0 mm and about 3.0 mm, or about 1.5 mm. In some embodiments, the tab 250 may have between 3 and 18 of the apertures 252, or between 5 and 16 of the apertures 252, or between 8 and 14 of the apertures 252, or 11 of the apertures 252. In some embodiments, the features 94 may define portions that are curved, i.e., concave or convex, and other portions that are angled, chamfered, cambered, or planar.

Additionally, as would be appreciated by those of ordinary skill in the pertinent art, the subject technology is applicable to any type of bag, pouch, package, and various other storage containers, e.g., snack, sandwich, quart, and gallon size bags. The subject technology is also adaptable to bags having double zipper, or multiple zipper, or other type of closure mechanisms.

INDUSTRIAL APPLICABILITY

The closure systems as described herein advantageously provide for containers or pouches that are re-usable and include sealing systems having enhanced sealing capabilities while being able to seal and unseal for an end user.

Numerous modifications will be apparent to those skilled in the art in view of the foregoing description. Accordingly, this description is to be construed as illustrative only and is presented for the purpose of enabling those skilled in the art to make and use the disclosure and to teach the best mode of carrying out same. The exclusive rights to all modifications which come within the scope of the application are reserved. All patents and publications are incorporated by reference.

We claim:

1. A container or pouch made entirely from an elastomer, comprising:

a body, comprising:

a front wall; and a rear wall that is connected to the front wall along a peripheral edge; and a closure system, comprising:

a front side having a front sealing profile that includes a male closure element that extends from a thickened region; and a rear side having a rear sealing profile that includes a female closure element and defining an opening into a cavity, wherein a centerline extends through the opening, the cavity, the male closure element, and the thickened region when the closure system is in a closed configuration, wherein the rear side comprises an inner portion that includes the entire cavity and an outer portion, wherein an entire thickness of the front wall measured in a direction parallel to the centerline is between about 30% and about 70% of a thickness of the thickened region, and wherein the thickness of the thickened region is measured in a direction parallel to the centerline and a total thickness of the closure system in the closed configuration is measured in a direction parallel to the centerline.

2. The container or pouch of claim 1, wherein the thickness of the thickened region is less than 35% of the total thickness of the closure system.

3. The container or pouch of claim 1, wherein the thickness of the thickened region is less than 25% of the total thickness of the closure system.

4. The container or pouch of claim 1, wherein the thickness of the thickened region is less than 20% of the total thickness of the closure system.

5. The container or pouch of claim 1, wherein the closure system further includes a left tab and a right tab that extend in an outward direction.

6. The container or pouch of claim 1, wherein the male closure element comprises a stem and a head portion that extends from the stem, wherein the head portion defines a height that is larger than a height of the stem, wherein the female closure element includes arms that define an opening into the cavity, and the opening defines a height, and wherein the height of the stem is at least 100% of the height of the opening.

7. The container or pouch of claim 6, wherein the height of the stem is at least 125% of the height of the opening.

8. The container or pouch of claim 6, wherein the height of the stem is at least 150% of the height of the opening.

9. A container or pouch made entirely from an elastomer, comprising:

a body, comprising:

a front wall; and a rear wall that is connected to the front wall along a peripheral edge; and a closure system, comprising:

a front side having a front sealing profile that includes a male closure element extending from a thickened region; and a rear side having a rear sealing profile that includes a female closure element and defining an opening into a cavity, wherein a centerline extends through the opening, the cavity, the front sealing profile, and the thickened region when the closure system is in a closed configuration, wherein the male closure element comprises a stem and a head portion that extends from the stem, wherein an entire thickness of the front wall measured in a direction parallel to the centerline is between about 40% and about 60% of a thickness of the thickened region measured in a direction parallel to the centerline, and wherein a height of the stem is measured in a direction that is perpendicular to the centerline and a height of the female closure element is measured in a direction that is perpendicular to the centerline.

10. The container or pouch of claim 9, wherein the rear side comprises an inner portion that includes the entire cavity and an outer portion, and wherein a thickness of the outer portion measured in a direction parallel to the centerline is at least 20% of the total thickness of the female closure element measured in a direction parallel to the centerline.

11. The container or a pouch of claim 10, wherein the thickness of the outer portion is at least 30% of the total thickness of the female closure element.

12. The container or a pouch of claim 9, wherein the height of the stem is between about 20% and 40% of the height of the female closure element.

13. The container or a pouch of claim 9, wherein the height of the stem is less than about 35% of the height of the female closure element.

14. The container or a pouch of claim 9, wherein the closure system further includes a left tab and a right tab that extend in an outward direction.

15. The container or a pouch of claim 14, wherein the left tab and the right tab include at least one of a protrusion or a groove.

16. The container or pouch of claim 9, wherein the thickness of the front wall is about 50% of the thickness of the thickened region.

17. A container or a pouch made entirely from an elastomer, comprising:

a body, comprising:

a front wall; and a rear wall that is connected to the front wall along a peripheral edge; and a closure system, comprising:

a front side having a front sealing profile that includes a male closure element extending from a thickened region, wherein the male closure element comprises a stem, and a head portion that extends from the stem; and a rear side comprising a rear sealing profile that includes a female closure element and defining an opening into a cavity, wherein a centerline extends through the opening, the cavity, and the thickened region when the closure system is in a closed configuration, wherein the rear side comprises an inner portion that includes the entire cavity and an outer portion, and wherein an entire thickness of the front wall measured in a direction parallel to the centerline is between about 20% and about 80% of a thickness of the thickened region measured in a direction parallel to the centerline.

18. The container or pouch of claim 17, wherein the male closure element defines a thickness of less than 3.0 mm.

19. The container or pouch of claim 18, wherein a thickness of the outer portion measured in a direction parallel to the centerline is at least 20% of a total thickness of the female closure element measured in a direction parallel to the centerline.

20. The container or pouch of claim 17 further comprising, a left tab and a right tab that each include a plurality of grooves or protrusions.

21. The container or pouch of claim 17 further comprising, a left tab and a right tab that each include a plurality of apertures.

22. The container or pouch of claim 17, wherein the outer portion defines a thickness of between 3.0 millimeters (mm) and 6 mm, and the male closure element defines a thickness of less than 3.5 mm.

23. A container or pouch made entirely from an elastomer, comprising:

a body, comprising:

a front wall; and a rear wall that is connected to the front wall along a peripheral edge; and a closure system, comprising:

a front side having a front sealing profile that includes a male closure element that comprises a stem extending from a thickened region and a head portion that extends from the stem; and a rear side having a rear sealing profile that includes a female closure element and defining a cavity, wherein a centerline extends through the cavity and the thickened region when the closure system is in a closed configuration, wherein the female closure element includes arms that define an opening into the cavity through which the centerline extends, and the opening defines a height measured in a direction that is perpendicular to the centerline, wherein a height of the stem measured in a direction that is perpendicular to the centerline is at least 100% of the height of the opening, wherein the rear side comprises an inner portion that includes the entire cavity and an outer portion, and wherein an entire thickness of the front wall measured in a direction parallel to the centerline is between about 30% and about 70% of a thickness of the thickened region measured in a direction parallel to the centerline.

24. The container or pouch of claim 23, wherein the thickness of the outer portion is at least 30% of the total thickness of the female closure element.

25. The container or pouch of claim 23, wherein the thickness of the outer portion is at least 40% of the total thickness of the female closure element.

26. The container or pouch of claim 23, wherein the thickness of the outer portion is at least 50% of the total thickness of the female closure element.

27. The container or pouch of claim 23, wherein the closure system further includes a left tab and a right tab that extend in an outward direction.

28. The container or pouch of claim 23, wherein the head portion defines a height that is larger than the height of the stem.

29. The container or pouch of claim 23, wherein the height of the stem is at least 125% of the height of the opening.

30. A container or pouch made entirely from an elastomer, comprising:

a body, comprising:

a front wall; and a rear wall that is connected to the front wall along a peripheral edge; and a closure system, comprising:

a front side having a front sealing profile that includes a male closure element that extends from a thickened region; and a rear side having a rear sealing profile that includes a female closure element and defining an opening into a cavity, and a centerline extends through the opening, the cavity, and the thickened region when the closure system is in a closed configuration, wherein the male closure element comprises a stem and a head portion that extends from the stem, wherein the head portion defines a height measured in a direction that is perpendicular to the centerline that is larger than a height of the stem measured in a direction that is perpendicular to the centerline, wherein the female closure element includes arms that define an opening into the cavity, and the opening defines a height measured in a direction perpendicular to the centerline, wherein the height of the stem is at least 125% of the height of the opening, and wherein an entire thickness of the front wall measured in a direction parallel to the centerline is between about 20% and about 80% of a thickness of the thickened region measured in a direction parallel to the centerline.

31. The container or pouch of claim 30, wherein the rear side comprises an inner portion that includes the entire cavity and an outer portion, and wherein a thickness of the outer portion measured in a direction parallel to the centerline is at least 20% of the total thickness of the female closure element measured in a direction parallel to the centerline.

32. The container or a pouch of claim 31, wherein the thickness of the outer portion is at least 30% of the total thickness of the female closure element.

33. The container or a pouch of claim 30, wherein the height of the stem is at least 150% of the height of the opening.

34. The container or a pouch of claim 30, wherein the closure system further includes a left tab and a right tab that extend in an outward direction.

35. The container or a pouch of claim 34, wherein the left tab and the right tab include at least one of a protrusion or a groove.

* * * * *